US008340310B2

(12) United States Patent
Ambrose et al.

(10) Patent No.: US 8,340,310 B2
(45) Date of Patent: Dec. 25, 2012

(54) DIAPHONIC ACOUSTIC TRANSDUCTION COUPLER AND EAR BUD

(75) Inventors: Stephen D. Ambrose, Longmont, CO (US); Samuel P. Gido, Hadley, MA (US); Jimmy W. Mays, Knoxville, TN (US); Roland Weidisch, Schonebeck (DE); Robert B. Schulein, Schaumburg, IL (US)

(73) Assignee: Asius Technologies, LLC, Beaverton, OR (US)

( * ) Notice: Subject to any disclaimer, the term of this patent is extended or adjusted under 35 U.S.C. 154(b) by 1130 days.

(21) Appl. No.: 12/178,236

(22) Filed: Jul. 23, 2008

(65) Prior Publication Data

US 2009/0028356 A1 Jan. 29, 2009

Related U.S. Application Data

(60) Provisional application No. 60/951,420, filed on Jul. 23, 2007, provisional application No. 61/038,333, filed on Mar. 20, 2008.

(51) Int. Cl.
*G10K 11/16* (2006.01)
*H04R 1/10* (2006.01)

(52) U.S. Cl. ..... 381/71.6; 381/71.7; 381/328; 381/329; 381/380

(58) Field of Classification Search ..... 381/71.1, 381/71.2, 71.6, 71.7, 150, 151, 165, 166, 381/312, 328, 329, 322, 380; 181/129–137
See application file for complete search history.

(56) References Cited

U.S. PATENT DOCUMENTS

| | | | | |
|---|---|---|---|---|
| 2,876,767 | A | 3/1959 | Wasserman | |
| 2,876,787 | A | 3/1959 | Wasserman | |
| 3,602,654 | A * | 8/1971 | Victoreen | 181/135 |
| 4,009,707 | A | 3/1977 | Ward | |
| 4,133,984 | A * | 1/1979 | Akiyama | 381/328 |
| 4,852,177 | A | 7/1989 | Ambrose | |
| 5,063,946 | A | 11/1991 | Wada | |
| 6,094,494 | A * | 7/2000 | Haroldson | 381/328 |
| 6,354,990 | B1 | 3/2002 | Juneau et al. | |

(Continued)

FOREIGN PATENT DOCUMENTS

DE 2825233 1/1979

(Continued)

OTHER PUBLICATIONS

William D. O'Brien and Yuhui Liu, "Evaluation of Acoustic Propagation Paths into the Human Head," New Directions for Improving Audio Effectiveness, 2005, pp. 15-1-15-24.

(Continued)

*Primary Examiner* — Levi Gannon
(74) *Attorney, Agent, or Firm* — Bishop & Diehl, Ltd.

(57) ABSTRACT

The disclosed methods and devices incorporate a novel expandable bubble portion which provides superior fidelity to a listener while minimizing listener fatigue. The expandable bubble portion may be expanded through the transmission of low frequency audio signals or the pumping of a gas to the expandable bubble portion. In addition, embodiments of the acoustic device may be adapted to consistently and comfortably fit to any ear, providing for a variable, impedance matching acoustic seal to both the tympanic membrane and the audio transducer, respectively, while isolating the sound-vibration chamber within the driven bubble. This reduces the effect of gross audio transducer vibration excursions on the tympanic membrane and transmits the audio content in a manner which allows the ear to utilize its full inherent capabilities.

46 Claims, 25 Drawing Sheets

U.S. PATENT DOCUMENTS

| | | | | |
|---|---|---|---|---|
| D478,062 | S | 8/2003 | Stephens | |
| 7,130,437 | B2 | 10/2006 | Stonikas et al. | |
| 7,227,968 | B2 | 6/2007 | van Halteren et al. | |
| 7,292,704 | B2 | 11/2007 | Lederer | |
| 7,362,875 | B2 * | 4/2008 | Saxton et al. | 381/322 |
| 7,425,196 | B2 | 9/2008 | Jorgensen et al. | |
| 2002/0076057 | A1 | 6/2002 | Voix | |
| 2007/0116319 | A1 | 5/2007 | Hagberg | |
| 2007/0270988 | A1 | 11/2007 | Goldstein et al. | |
| 2008/0015463 | A1 | 1/2008 | Goldstein | |
| 2008/0031475 | A1 | 2/2008 | Goldstein | |
| 2008/0037797 | A1 | 2/2008 | Goldstein et al. | |
| 2008/0137873 | A1 | 6/2008 | Goldstein | |
| 2008/0144842 | A1 | 6/2008 | Goldstein et al. | |
| 2008/0181419 | A1 | 7/2008 | Goldstein et al. | |
| 2008/0181442 | A1 | 7/2008 | Goldstein | |
| 2008/0187163 | A1 | 8/2008 | Goldstein et al. | |
| 2008/0212787 | A1 | 9/2008 | Goldstein et al. | |
| 2008/0219486 | A1 | 9/2008 | Goldstein et al. | |
| 2008/0240458 | A1 | 10/2008 | Goldstein | |
| 2008/0253583 | A1 | 10/2008 | Goldstein et al. | |
| 2008/0299339 | A1 | 12/2008 | Keady | |
| 2008/0311324 | A1 | 12/2008 | Keady | |
| 2009/0007596 | A1 | 1/2009 | Goldstein et al. | |
| 2009/0010442 | A1 | 1/2009 | Usher et al. | |
| 2009/0012420 | A1 | 1/2009 | Keller | |
| 2009/0014014 | A1 | 1/2009 | Roos et al. | |
| 2009/0022294 | A1 | 1/2009 | Goldstein et al. | |
| 2009/0022353 | A1 | 1/2009 | Goldstein et al. | |
| 2009/0034765 | A1 | 2/2009 | Boillot et al. | |
| 2009/0067661 | A1 | 3/2009 | Keady et al. | |
| 2009/0071486 | A1 | 3/2009 | Perez et al. | |
| 2009/0071487 | A1 | 3/2009 | Keady | |
| 2009/0130423 | A1 | 5/2009 | Keady | |
| 2009/0147966 | A1 | 6/2009 | McIntosh et al. | |
| 2009/0155518 | A1 | 6/2009 | Keady | |
| 2009/0173353 | A1 | 7/2009 | Purcell et al. | |
| 2009/0192407 | A1 | 7/2009 | Keady et al. | |
| 2009/0232684 | A1 | 9/2009 | Hirata et al. | |
| 2010/0030131 | A1 | 2/2010 | Morriss et al. | |

FOREIGN PATENT DOCUMENTS

| | | | |
|---|---|---|---|
| EP | 0 383 483 | | 8/1990 |
| EP | 1 272 003 | A1 | 1/2003 |
| GB | 2323295 | A | 9/1998 |
| JP | 61238198 | A | 10/1986 |
| JP | 06-335473 | | 12/1994 |
| JP | 06-335473 | A | 12/1994 |
| KR | 10-1990-0013806 | A | 9/1990 |
| WO | WO86/01399 | | 3/1986 |
| WO | WO99/31934 | | 6/1999 |
| WO | WO99/31935 | | 6/1999 |
| WO | WO-00/08895 | | 2/2000 |
| WO | WO 01/00267 | A1 | 1/2001 |
| WO | WO02/082768 | A1 | 10/2002 |
| WO | WO03/005765 | A2 | 1/2003 |
| WO | WO2009/015210 | A2 | 1/2009 |
| WO | WO2009/055347 | A2 | 4/2009 |
| WO | 2009-125186 | A1 | 10/2009 |

OTHER PUBLICATIONS

Jozef Zwislocki, "Factors Determining the Sound Attenuation Produced by Earphone Sockets," The Journal of the Acoustical Society of America, 1955, vol. 1, No. 1, pp. 146-154.

Jozef Zwislocki, "In Search of the Bone-Conduction Threshold in a Free Sound Field," The Journal of the Acoustical Society of America, 1957, vol. 29, No. 7, pp. 795-804.

U. Staudinger, R. Weidisch, Y. Zhu, S. P.Gido, D. Uhrig, J. W. Mays, H. Iatrou and N. Hadjichristidis, "Mechanical Properties and Hysteresis Behavior of Multigraft Copolymers," Macromolecular Symposia, 2006, 233, pp. 42-50.

Yuqing Zhu, Engin Burgaz, Samuel P. Gido, Ulrike Staudinger, Roland Weidisch, David Uhrig and Jimmy W. Mays, "Morphology and Tensile Properties of Multigraft Copolymers With Regularly Spaced Tri-, Tetra-, and Hexafunctional Junction Points," Macromolecules 2006, 39, pp. 4428-4436.

John Compton, "Notes on the Diaphone," The Organ, 1923, vol. 3, No. 9, pp. 42-47.

Jimmy W. Mays, David Uhrig, Samuel Gido, Yuqing Zhu, Roland Weidisch, Hermis Iatrou, Nikos Hadjichristidis, Kunlun Hong, Frederick Beyer, Ralf Lach and Matthias Buschnakowski, "Synthesis and Structure—Property Relationships for Regular Multigraft Copolymers," Macromolecular Symposia, 2004, 215, pp. 111-126.

R. Weidisch, S. P. Gido, D. Uhrig, H. Iatrou, J. Mays and N. Nadjichristidis, "Tetrafunctional Multigraft Copolymers as Novel Thermoplastic Elastomers," Macromolecules 2001, 34, pp. 6333-6337.

International Search Report for PCT/US2010/034237, issued Dec. 23, 2010.

"Sound Fit(TM) In-Canal Sound Delivery and Custom Fit Sleeve for Bluetooth(TM) Headsets". http://chait.ctia.org/eTechw2009public/index.cfm?fuseaction=main.viewEntry&productID=692&start=1&subCat=5&scoreStatus=all&ct=1[3/30/2009_12:41:13_PM]

E-Tech Awards 2009 Public Site 2009.

Compton, John, "Notes on the Diaphone", *The Organ* London, vol. 3, No. 9 Jul. 1, 1923, 42-47.

Mays, Jimmy W. et al., "Synthesis and Structure—Property Relationships for Regular Multigraph Copolymers", *Macromol. Symp.* vol. 215 2004, 111-126.

O'Brien, Jr., William D. et al., "Evaluation of Acoustic Propagation Paths into the Human Head", *New Directions for Improving Audio Effectiveness* 2005, 15-1 to 15-24.

Staudinger, U. et al., "Mechanical Properties and Hysteresis Behaviour of Multigraft Copolymers", *Macromol. Symp.* 2006 , 42-50.

Tiku, Nitasha, "When his bank cut the cord, Kevin Semcken faced a tough choice: Stick to his own big plans? Or listen to his board and play it safe?". *Inc.* Jul./Aug. 2009, 58-61.

Weidisch, R. et al., "Tetrafunctional Multigraft Copolymers as Novel Thermoplastic Elastomers", *Macremolecules* vol. 34 2001, 6333-6337.

Zhu, Yuqing et al., "Morphology and Tensile Properties of Multigraft Copolymers with Regularly Spaced Tri-, Tetra-, and Hexafunctional Junction Points", *Macromolecules* vol. 39 2006, 4428-4436.

Zwislocki, Jozef, "Factors Determining the Sound Attentuation Produced by Earphone Sockets", *The Journal of the Acoustical Society of America* vol. 27, No. 1 Jan. 1, 1955, 146-154.

Zwislocki, J., "In Search of the Bone-Conduction Threshold in a Free Sound Field", *The Journal of the Acoustical Society of America* vol. 29, No. 7 Jul. 1, 1957, 795-804.

English Abstract from Japan Patent Publication No. 01101794, published Apr. 19, 1989.

English Abstract from Japan Patent Publication No. 52019905, published Feb. 15, 1977.

English Abstract from Japan Patent Publication No. 53147526, published Dec. 22, 1978.

English Abstract from Japan Patent Publication No. 55047713, published Apr. 4, 1980.

English Abstract from Japan Patent Publication No. 61238198, published Oct. 23, 1986.

English Abstract from European Patent Publication No. EP0755168 published Jan. 22, 1997.

International Search Report for PCT/US2011/059137, issued Apr. 27, 2012.

International Search Report for PCT/US2011/032223, issued Feb. 8, 2012.

* cited by examiner

DIAPHONIC ACOUSTIC TRANSDUCTION COUPLER AND EAR BUD

CROSS-REFERENCE TO RELATED APPLICATIONS

This application claims the benefit under 35 U.S.C. §119 (e) of U.S. Provisional Application No. 60/951,420, filed Jul. 23, 2007 and U.S. Provisional Application No. 61/038,333, filed Mar. 30, 2008, the disclosures of which are hereby incorporated herein by reference.

BACKGROUND

1. Field of the Invention

This invention relates generally to the field of listening devices. More specifically, the invention relates to novel personal listening devices with increased discernability and reduced listener fatigue.

2. Background of the Invention

The human ear is sensitive to sound pressure levels over 12 orders of magnitude. This broad range of sensitivity, which is measurable as discernability, is easily overwhelmed and restricted by the artificial sound and pressure concentrations extant in devices such as hearing aids, ear buds, in-the-ear monitors and headphones. This is different than mere sensitivity or susceptibility to overall volume levels. Discernability depends upon the ear's inherent ability to discern differences in sound pressure levels at different audio frequencies, relative to one another.

Conventional in-ear audio technologies occlude the ear canal to a greater or lesser degree with an ear mold, plug or other means of a device which contains a transducer and joins it to the canal, thereby creating a closed volume out of the ear canal itself. The ear is naturally suited to act as an impedance matching horn or Helmholtz resonator, not as a closed sound-vibration chamber. Occluding the ear canal with an audio transducer lowers the ear's discernability. Audio transducers comprise electromechanical mechanisms which involve greater mass and inertia than the delicate components of the inner ear. Directly coupling these to the tympanic membrane by creating a closed sound-vibration resonance chamber out of the ear canal markedly degrades the discernability of the ear by forcing it to emulate the transducer amplitude excursions as opposed to natural sound field excitations of the open ear.

Audio resonances, for example those occurring in environments such as rooms or the outdoors, are discernable to the unoccluded human ear. Blind persons have been known to effectively judge their proximity to environmental obstructions through acoustic differentiation based on changes in environmental sound sources external to the ear, which are perceived with the natural resonance of the open non-occluded ear. Closing the ear canal changes its natural open resonance condition (which is compensated for by the auditory system) to an unnatural hearing condition.

Even at very high sounds pressure levels above the threshold of pain in human hearing, the vibrational excursions of the tympanic membrane are not visible without the use of extreme magnification. In contrast, diaphragm excursions of conventional magnetic moving coil and moving armature devices are large and easily observed by the naked eye. Coupling such devices directly to the tympanic membrane by creating a closed sound-vibration chamber within the ear canal forces the tympanic membrane to emulate these same gross excursions and also to respond to average pressure changes in addition to sound pressures. This changes the natural vibrational modes and frequency response of the tympanic membrane and thereby inhibits its ability to differentiate sounds.

Personal listening devices have become extremely wide spread in recent years while physicians, audiologists and news agencies have continued to warn against hearing damage and old age deafness resulting from their use. These admonitions generally fail to delineate the specific mechanical factors causing such hearing loss and rather infer that listeners in general choose to listen to such devices at inordinate volume levels, or that these devices do unspecified damage despite reasonable use. Potential damage from choosing to listen at excessive volume levels is not limited to the use of in-ear or on-ear devices. Rather, the actual cause for concern is attributable to the fact that personal listening devices occlude the ear canal, thereby damping the tympanic membrane and reducing its sensitivity to audio vibrations, and further create a closed-canal pressure coupling of the audio transducer to the tympanic membrane which forces it to undergo unnaturally large excursions. Such abnormal excursions interrupt the normal tympanic modes of vibration, thereby rendering the ear even less sensitive and able to perceive sound naturally. The harmonic and other significant audio nuances of natural hearing are thereby lost and replaced by artificial membrane excitations whose audio resolution is insufficient to orient blind persons normally able to discern and navigate their environments by "seeing" with their unimpaired natural resort to louder volume levels in a futile effort to hear adequately. This is especially observable in cell phone and hearing aid users. In general use, prolonged exposure to these conditions may lead to permanent reductions in sensitivity and sound perception.

By simply forcing air through the Eustachian tubes into the middle ear volume repeatedly one can cause various over-excursions of the tympanic membrane. Hearing under these conditions is severely hampered. Just because the listener can still hear during the lesser tympanic over-excursions caused by conventional devices does not mean that he is hearing optimally. Due to the factors described above, audio fatigue from personal listening devices often occurs much sooner than it does with ambient sounds or even those produced by conventional loudspeakers in a concert or in a movie theater, given the same average volume levels.

In addition, the human auditory system incorporates mechanisms to reduce the acoustic input when levels become potentially damaging. The middle ear muscle reflex tightens the stapedius and tensor tympani muscles when loud sounds excite the hearing system. This reduces the amplitude of the vibrations conducted by the bones of the middle ear to the cochlea. The cochlea itself exhibits a threshold shift that reduces its neuronal output when stimulated by sustained loud sounds, at least in part due to the depletion of the available chemical energy. These mechanisms operate through the normal hearing pathway. Lowering the sound pressure in the ear canal reduces the chance of exciting these protection mechanisms that degrade the perception of sound.

Bone conduction provides another acoustic pathway to the hearing system, whereby sounds that vibrate the skull are able to excite the cochlea without a contribution from the tympanic membrane. It appears that increasing the mean or static pressure in the ear canal may modulate the effect of bone conduction and thereby alter the perceived sound. Conventional closed-canal devices modulate the static pressure in the ear canal and may contribute to this effect.

Although poor sound quality, audio fatigue and ear canal irritations are commonly associated with conventional in-ear devices, personal listening device audio transducers have been traditionally evaluated according to their performance relative to the acoustical impedance of air, measured in acoustic ohms according to Ohms Law. The primary problem is that once these audio transducers are partially or wholly sealed into the ear canal, the acoustic impedance of air is no longer applicable, the definitive factor now being the compressibility of air in a fixed volume. This confined air mass effectively transmits the energy of high amplitude transducer excursions to the ear drum. Hence the tympanic over-excursions, vibrational mode aberrations and occlusions described above are evidenced in all conventional prior art personal listening devices and hearing aids to greater or lesser degree.

Hearing aid manufacturers have resorted to porting their ear molds in an effort to overcome occlusion effects and the often overwhelming bass frequencies which occur when their devices form an acoustic seal of the ear canal. Personal listening devices such as ear buds utilize various methods of silicone, hollow polymer plugs, or foam which seal inconsistently, causing impaired audio performance as well as tissue pain from being repeatedly forced into uncomfortable positions by the user in an attempt to hear better. Custom molded devices such as in-the-ear stage monitors all create a closed chamber within the ear canal itself and suffer from the resulting audio degradations described above.

The aforementioned hearing aid porting only alleviates a small portion of the sound degradation attendant upon creating an artificial closed resonance chamber out of the ear canal. Hearing aids must maintain an adequate acoustic sealing of the ear canal in order to maintain isolation and prevent painful feedback conditions in which the device squeals or shrieks loudly as a consequence of the microphone repeatedly amplifying sounds which are meant to be contained in the acoustically sealed canal. Hence, the device remains mainly sealed and the ear canal is forced into becoming a closed resonance chamber. Extant devices, be they hearing aids, ear buds, or in-the-ear monitors, have no provision for containing their primary effective sound-vibration coupling chambers away from the tympanic membrane, and to this degree they limit and degrade the operation of the listener's ear regardless of the audio quality of the device. In addition to inhibiting the listener's own inherent discernability of sound, the abnormally large tympanic membrane excursions they cause are potentially physically damaging to the listener's hearing over time.

Additionally, isolation of the listener from the outside environment constitutes an annoying and often dangerous condition attendant upon the occlusion of the ear canal by conventional audio devices. When not posing a dangerous condition, conventional listing devices, limit the natural interaction between the listener and those about them. Those listening to music are normally cut off from external conversation, and often commonly complain of not being able to understand others.

Although breakthrough audio technologies often occur, they are limited by being applied in accordance with conventional in-ear speaker technology embodiments and do not compensate for the tympanic vibrational aberrations described above. Problems with user discomfort, occlusion, isolation, inadequate audio discernability and environmental orientation remain.

Consequently, there is a need for a personal listening device which reduces fatigue and possible damage to hearing associated with artificial pressure in the ear canal, and allows for the mixing of music or voice communications with outside sound to provide the listener with adequate environmental awareness, while improving discernability and the fidelity of the audio signal.

BRIEF SUMMARY

The disclosed methods and devices incorporate a novel expandable bubble portion which provides superior fidelity to a listener while minimizing listener fatigue. The expandable bubble portion may be expanded through the transmission of low frequency audio signals or the pumping of a gas to the expandable bubble portion. In addition, embodiments of the acoustic device may be adapted to consistently and comfortably fit to any ear, providing for a variable, impedance matching acoustic seal to both the tympanic membrane and the audio transducer, respectively, while isolating the sound-vibration chamber within the driven bubble. This reduces the effect of gross audio transducer vibration excursions on the tympanic membrane and transmits the audio content in a manner which allows the ear to utilize its full inherent capabilities. Further aspects and advantages of the methods and devices will be described below.

In an embodiment, an acoustic device comprises an acoustic transducer. The acoustic transducer has a proximal surface and a distal surface. The acoustic device also comprises an expandable bubble portion in fluid communication with the proximal surface of the acoustic transducer. The expandable bubble portion completely seals the proximal surface of the acoustic transducer. In addition, the expandable bubble portion has an inflated state and a collapsed state, where the expandable bubble portion is filled with a fluid medium in said inflated state. The expandable bubble portion is adapted to conform to an ear canal in the inflated state In another embodiment, an acoustic device comprises an expandable bubble portion. The device further comprises an acoustic transducer disposed distal to the expandable bubble portion. In addition, the device comprises a diaphonic assembly coupled to the expandable bubble portion and the acoustic transducer. The diaphonic assembly has a one way egress valve and a one way ingress valve. The egress valve opens when the transducer is displaced proximally and the ingress diaphragm closes when the transducer is displaced proximally.

In an embodiment, a method of transmitting sound to an ear comprises providing an acoustic device comprising an acoustic transducer having a proximal surface and a distal surface, and an expandable bubble portion in fluid communication with the proximal surface of the acoustic transducer. The expandable bubble portion has an inflated state and a collapsed state and is filled with a fluid medium in the inflated state. The method further comprises inserting the expandable bubble portion into an ear canal. In addition, the method comprises inflating the expandable bubble portion to the inflated state so as to form a seal within the ear. The method also comprises transmitting sound through the acoustic transducer into the expandable bubble portion so as to resonate the expandable bubble portion and transmit sound to the ear.

Embodiments of the device will allow the listener to selectively and easily perceive as much or as little ambient environmental sound as is desirable and safe, while simultaneously listening to music, communication, or other audio content. Other embodiments of the device may allow the user to transform a commercially available personal stereo or similar device into a personal hearing aid adequate for the hearing impaired, which affords a greater and more user controllable ability to hear the environment as well as popular audio media than conventional hearing aids while also allowing the user to not appear handicapped.

The foregoing has outlined rather broadly some of the features and technical advantages of embodiments of the invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Figure 1:
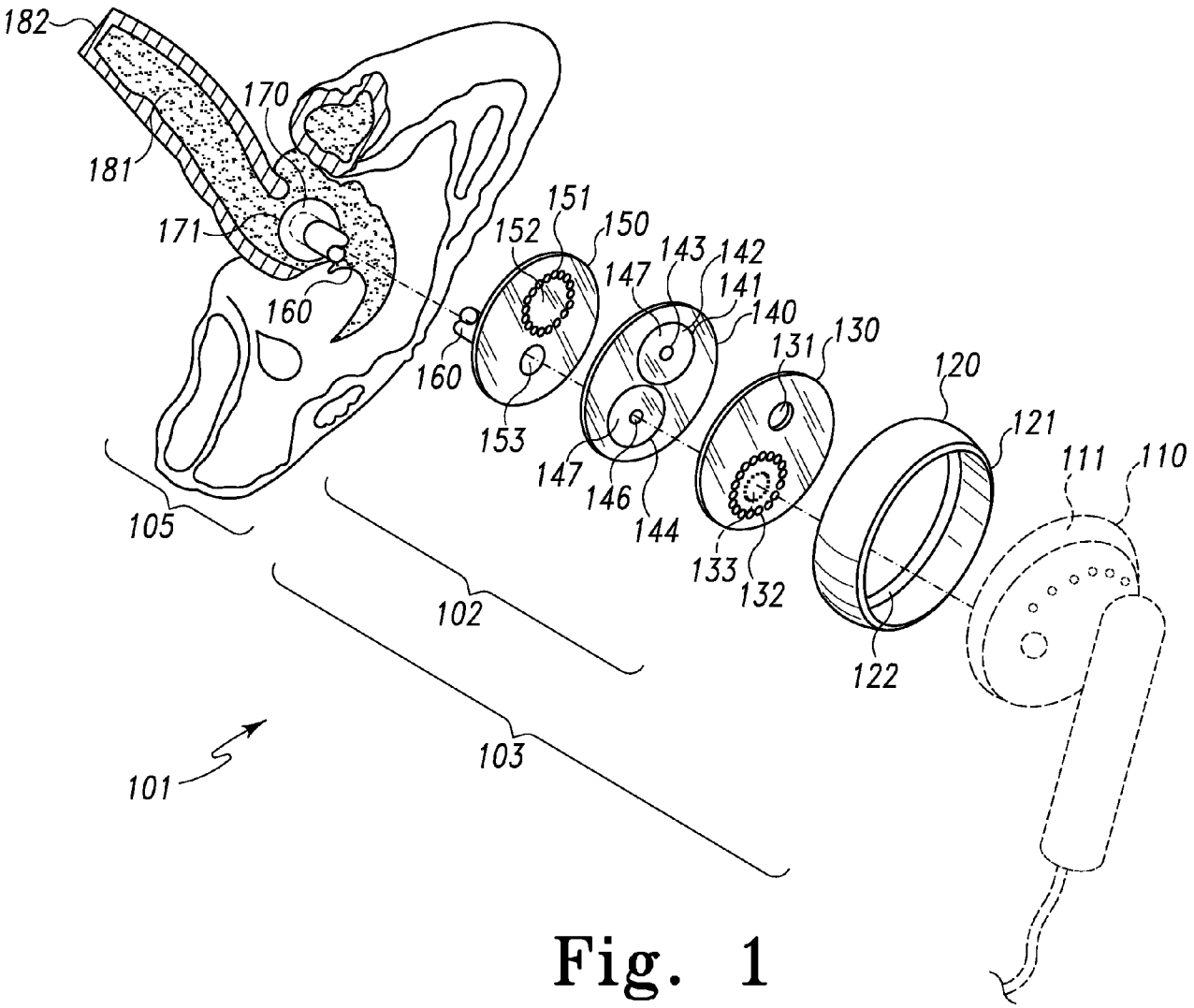
FIG. 1 is an exploded perspective view of an embodiment of a frontally mounted audio transducer, diaphonic assembly and an expandable bubble portion assembly.

Certain terms are used throughout the following description and claims to refer to particular system components. This document does not intend to distinguish between components that differ in name but not function.

In the following discussion and in the claims, the terms "including" and "comprising" are used in an open-ended fashion, and thus should be interpreted to mean "including, but not limited to . . . ". Also, the term "couple" or "couples" is intended to mean either an indirect or direct connection. Thus, if a first device couples to a second device, that connection may be through a direct connection, or through an indirect connection via other devices and connections. "Coupled" may also refer to a partial or complete acoustic seal.

As used herein, the term "acoustic transformer" refers to the ability to optimally impedance match both the audio transducer and a listener's tympanic membrane at different impedances according to their best natural audio performance.

As used herein, an "acoustic ohm" may refer to any one of several units measuring sound resistance. The sound resistance across a surface in a given medium may be defined to be the pressure of the sound wave at the surface divided by the volume velocity.

As used herein, the term "acoustic transducer" or "audio transducer" may refer to any device, either electrical, electronic, electro-mechanical, electromagnetic, photonic, or photovoltaic, that converts an electrical signal to sound. For example, an acoustic transducer may be a conventional audio speaker as used in personal listening devices or hearing aids. Although microphones also constitute audio transducers, they are referred to herein as "microphone(s)", reserving audio transducers for reference to sound generating speakers.

As used herein, the term "diaphonic" may describe the ability of a device or structure to pass through, transfer or transmit sound with minimal loss in discernability and sound quality. For example, "diaphonic valve" may refer to a valve structure which has the ability to pass through sound with high discernability.

As used herein, the term "discernability" may refer to the quality of sound necessary to comprehensive recognition of its entire audio content. "Discernability" may also refer to the differentiation of all sound content variables (frequency, volume, dynamic range, timbre, tonal balance, harmonic content, etc.) independently and relative to each other according to the unhampered natural ability of the ear.

As used herein, the terms "resonant" or "acoustically resonant" may refer to the property of objects or elements to vibrate in response to acoustic energy.

As used herein, the terms, "bubble" or "bubble portion" may refer to substantially hollow, balloon-like structures which may be filled with a fluid medium. Furthermore, it is to be understood that the "bubble" or "bubble portion" may be any shape and should not be limited to spherical shapes.

DETAILED DESCRIPTION OF THE PREFERRED EMBODIMENTS

FIG. 1 illustrates an exploded perspective view of an embodiment of an acoustic device 101. In general, acoustic device 101 comprises an expandable bubble portion 170 coupled to a diaphonic assembly 103. Acoustic device 101 is removably attached to an audio transducer 110. Acoustic device 101 preferably maintains a continuous acoustic and atmospheric pressure seal through an engaging enclosure such as housing 120. As will be explained in more detail below, expandable bubble portion 170 is in fluid communication with acoustic transducer 110 and may be inserted into the ear canal 181 in a collapsed state to ease insertion. The acoustic transducer 110 has a proximal surface and a distal surface. As used herein, "proximal" refers to structures and elements nearer the tympanic membrane whereas "distal" refers to structures and elements further away from the tympanic membrane. Diaphonic assembly 103 may fit snugly against the outer ear. Once inserted into the ear 191, expandable bubble portion 170 may be expanded or inflated into an expanded state. The expandable bubble portion 170 may be inflated via a separate means or by the mere action of the audio transducer 110 transmitting sound through the diaphonic assembly 103. When expanded, expandable bubble portion 170 substantially conforms to the inside of the ear canal 181. Although the numerous advantages of the expandable bubble portion 170 will be described in more detail below, the expandable bubble portion 170 provides a means of transmitting sound through the actually tissue (e.g. bone, skin) of the inner ear canal as well as to the tympanic membrane. Furthermore, the material of which the expandable bubble portion 170 may be fabricated has properties which provide superior audio quality and fidelity when compared to existing earphone technologies.

I. Expandable Bubble Portion

In general, expandable bubble portion 170 is a hollow bladder which is filled with a fluid medium when expanded. As used herein, "fluid" may refer to a liquid or a gas. The interior cavity of bubble portion 170 preferably does not contain anything else except for the aforementioned fluid during operation of acoustic device 101. It is emphasized that bubble portion 170 is in open and fluid communication with the proximal surface (e.g. the side of the acoustic transducer facing the tympanic membrane) of the acoustic transducer 110. That is, air being pushed by the acoustic transducer 110 travels into, fills, and resonates expandable bubble portion 170. Accordingly, bubble portion does not merely serve as a cushion or comfort function, but actually acts as additional means of superior acoustic transmission (e.g. an additional acoustic driver within the ear). As described in more detail infra, the fluid (i.e. air) within bubble portion 170 may capture the acoustic transmission from the transducer 110 through sound port 160 and cause the bubble portion 170 to pulsate. Air in the listener's external auditory canal 181 is gradually and continuously refreshed by air from the diaphonic assembly 103 and which may emanate through pores in the expandable bubble portion 170 and may be gradually diffused past the expandable bubble portion 170.

In its expanded state, expandable bubble portion 170 may take on any suitable shape. Ideally, the shape of expandable bubble portion 170 in the expanded state is optimized for superior sound and user comfort. However, in typical embodiments, expandable bubble portion 170 may comprise a substantially spherical shape. In addition, expandable bubble portion 170 may conform to the wall of the listener's external auditory (ear) canal 181 in a user adjustable manner. Intra-canal air temperatures and atmospheric pressures may be continually equalized with ambient environmental conditions for wearer comfort. This variable conformation of expandable bubble portion 170 may also assist with mitigating perspiration and allowing for pressure equalization during altitude changes as in an airplane or a sharply descending road.

In at least one embodiment, expandable bubble portion 170 is porous. That is, expandable bubble portion 170 may have a plurality of pores, allowing expandable bubble portion 170 to be breathable or semi-permeable to the fluid medium within bubble portion 170. Air emanating through the pores 171 may also create a variable air cushion between the expandable bubble portion 170 and the listener's external auditory canal 181 wall, helping to insulate the wall from tissue discomfort and inflammation, while maintaining a variable acoustic seal. The adjustable variation of pressurization and diffusion rates in the expandable bubble portion 170 determines both membrane size and rigidity, thereby independently determining intra-canal impedance as well as audio transducer impedance, and constitutes a user adjustable acoustic impedance matching transformer. Audio content discernability may be greatly enhanced by said user adjustment of the variable acoustic seal which affords separate pressure couplings to the audio transducer 111 and the listener's tympanic membrane at individual impedances optimum to both. Additionally, pressure venting of the expandable bubble portion 170 through pores 171 may also control the atmospheric air mass refresh rate and air cushioning, and variation of pore size may determine the amount of environmental sound waves transmitted or excluded into the ear canal 181. In another embodiment, expandable bubble portion 170 is non-porous or impermeable to the fluid medium within bubble portion 170. In such embodiments, bubble portion 170 may act solely as a driver for sound to the tympanic membrane and also as conductive medium to conduct sound to the cephalic tissue.

The number, size, density and location of the pores 171 in the wall determine different aspects of the interface between the device 101 and the ear canal wall 181. Expandable bubble portion 170 may be microporous (pores with average diameter less than or equal to 1 micron) or nanoporous (pores with average diameter of less than or equal to 100 nm). However, pores may have any suitable diameter. The pattern of pores 171 also impacts device acoustics and the properties of the expandable bubble portion 170. Additionally, the elasticity inherent in the polymer material of which the expandable bubble portion 170 is composed, affords potential dilatations and constrictions of said pores 171 as the membrane flexes during vibration. This allows for enhanced control of membrane displacement, as well as a controllable enhancement of acoustic dynamic range and pressure refresh rate. The bubble portion 170 is easily replaceable and disposable and can be manufactured in embodiments which accommodate different user requirements as to size (small, medium, and large, etc.), pressure loading, refresh rates, degree of air cushioning, membrane rigidity and other parameters.

The expandable bubble portion 170 is preferably composed of a polymeric material with optimal acoustic and mechanical properties for transmission of acoustic signals to the ear. However, resonant member 170 may comprise any suitable material such as composites, fabrics, alloys, fibers, etc.

In an embodiment, the polymer is soft having a low initial Young's modulus of no more than about 10.0 MPa, preferably no more than about 5.0 MPa, most preferably no more than about 1.0 MPa. The polymer may be highly extensible. In embodiments, the polymer may have a strain of greater than about 500% before breaking, more preferably supporting a strain of greater than about 1000% before breaking, and most preferably supporting a strain of greater than about 11200% before breaking. The polymer may have an ultimate tensile strength of greater than about 5.0 MPa, alternatively greater than about 10.0 MPa, alternatively greater than about 12.0 MPa. The polymer may experience a minimum of permanent deformation after being mechanically strained to high deformations and then released.

Without being limited by theory, the low Young's modulus may allow the expandable bubble portion to be inflated with very little air pressure. The lower air pressure may reduce back pressure on the audio transducer and diaphonic valve membranes thus improving sound fidelity while also improving in-ear comfort and safety. Finally, lower inflation pressure may allow the expandable bubble portion to be inflated by pressure generated by the audio transducer itself via said diaphonic assembly or other device.

Again without being bound by theory, the high extensibility and high mechanical strength of the polymer allows very small amounts of the material to be molded or blown into an extremely light and thin walled expandable bubble portion 170 which is large enough to fill the ear canal. The polymer itself is preferably a lightweight material with a density in the range of about from approximately 0.1 g/cm$^3$ to about 2 g/cm$^3$. The inertial resistance of the expandable bubble portion 170 to vibrational motion may also help to impedance match the audio transducer. However, if resistance is too high, it may degrade the fidelity of its sound reproduction, and thus the expandable bubble portion must be as thin and light as possible while still maintaining mechanical integrity and impedance matching properties. The use of pores in the polymeric membrane may mitigate these issues. The low residual strain after high degrees of mechanical deformation allows the expandable bubble portion 170 to maintain their shape and functionality through repeated inflation and deflation cycles during use.

The expandable bubble portion 170 and the diaphragm membranes of the diaphonic assembly may both be made of flexible or elastomeric polymer materials. Classes of suitable materials include block copolymers, triblock copolymers, graft copolymers, silicone rubbers, natural rubbers, synthetic rubbers, plasticized polymers, vinyl polymers. Examples of suitable rubbers and elastomers include without limitation, polyisoprene (natural rubber), polybutadiene, styrene-butadiene rubber (SBR), polyisobutylene, poly(isobutylene-co-isoprene) (butyl rubber), poly(butadiene-co-acrylonitrile) (nitrile rubber), polychloroprene (Neoprene). acrylonitrile-butadiene-styrene copolymer (ABS rubber), chlorosulphanated polyethylene, chlorinated polyethylene, ethylene propylene copolymer (EPDM), epichlorohydrin rubber, ethylene/acrylic elastomer, fluoroelastomer, perfluoroelastomer, urethane rubber, polyester elastomer (HYTREL), or combinations thereof.

Examples of silicone rubbers that may used include without limitation polydimethylsiloxane (PDMS), and other siloxane backbone polymers where the methyl side groups of PDMS are partially or completely substituted with other functionalities such as ethyl groups, phenyl groups and the like. In embodiments, the polymeric material may comprise block copolymers such as poly (styrene-b-isoprene-b-styrene), poly(styrene-b-butadiene-b-styrene), poly(styrene-b-butadiene), poly(styrene-b-isoprene), or combinations thereof. In some embodiments, the block copolymer may comprise a diene block which is saturated. In one embodiment, the polymeric material comprises Kraton and K-Resins.

In further embodiments, the polymeric material may comprise block copolymers of molecular structure: AB, ABA, ABAB, ABABA, where A is a glassy or semicrystalline polymer block such as without limitation, polystyrene, poly(alpha-methylstyrene), polyethylene, urethane hard domain, polyester, polymethylmethacrylate, polyethylene, polyvinyl chloride, polycarbonate, nylon, polyethylene teraphthalate (PET), poly(tetrafluoroethylene), other rigid or glassy vinyl polymer, and combinations thereof. B is an elastomeric block material such as polyisoprene, polybutadiene, polydimethylsiloxane (PDMS), or any of the other rubbers and elastomers listed above. In other embodiments, the block copolymers may be random block copolymers.

The polymeric material may also comprise elastomeric materials based on graft copolymers with rubbery backbones and glassy side branches. Examples of rubbery backbone materials include without limitation, any of the rubbers and elastomers listed above. The glassy side branch materials include without limitation polystyrene, poly(alpha-methylstyrene), polyethylene, urethane hard domain, polyester, polymethylmethacrylate, polyethylene, polyvinyl chloride, other rigid or glassy vinyl polymer, or combinations thereof. Furthermore, the polymeric material may comprise graft copolymer materials described in the following references, which are all herein incorporated by reference in their entireties for all purposes: R. Weidisch, S. P. Gido, D. Uhrig, H. Iatrou, J. Mays and N. Hadjichristidis, "Tetrafunctional Multigraft Copolymers as Novel Thermoplastic Elastomers," *Macromolecules* 12001, 34, 6333-6337, J. W. Mays, D. Uhrig, S. P. Gido, Y. Q. Zhu, R. Weidisch, H. Iatrou, N. Hadjichristidis, K. Hong, F. L. Beyer, R. Lach, M. Buschnakowski. "Synthesis and structure—Property relationships for regular multigraft copolymers" *Macromolecular Symposia* 12004, 215, 1111-126, Yuqing Zhu, Engin Burgaz, Samuel P. Gido, Ulrike Staudinger and Roland Weidisch, David Uhrig, and Jimmy W. Mays "Morphology and Tensile Properties of Multigraft Copolymers With Regularly Spaced Tri-, Tetra- and Hexa-functional Junction Points" *Macromolecules* 12006, 39, 4428-4436, Staudinger U, Weidisch R, Zhu Y, Gido S P, Uhrig D, Mays J W, Iatrou H, Hadjichristidis N. "Mechanical properties and hysteresis behaviour of multigraft copolymers" *Macromolecular Symposia* 12006, 233, 42-50.

The polymeric material may be a filled elastomer in which any of the materials described above may be combined with a reinforcing or filling material or colorants such as pigments or dyes. Examples of fillers and colorants include, but are not limited to, carbon black, silica, fumed silica, talc, calcium carbonate, titanium dioxide, inorganic pigments, organic pigments, organic dyes.

In another embodiment, expandable bubble portion 170 may comprises polymer materials with limited or no extensibility (i.e. inelastic). As used herein, limited extensibility or non-extensible materials may refer to materials which are substantially inelastic. These materials and the expandable bubble portion 170 may be perforated with small (nanometer, micrometer to millimeter size) holes or may be non-perforated. The materials listed below may be used in the pure state to form films or they may be modified with the addition of plasticizers or fillers. The films or their surfaces may be chemically treated or treated with heat, radiation (corona discharge, plasma, electron beam, visible or ultraviolet light), mechanical methods such as rolling, drawing or stretching, or some other method or combination of methods, to alter their physical or chemical structure, or to make their surfaces physically or chemically different from the bulk of the films.

Any suitable non-extensible or limited extensibility polymers may be used. However, examples of suitable non-extensible or limited extensibility polymers include polyolefins, polyethylene (PE), low density polyethylene (LDPE), linear low density polyethylene (LLDPE), high density polyethylene (HDPE), ultrahigh density polyethylene (UHDPE), polyproplylene (PP), ethylene-propylene copolymers, poly (ethylene vinylacetate) (EVA), poly(ethylene acrylic acid) (EAA), polyacrylates such as, but not limited to, polymethylacrylate, polyethylacrylate, polybutylacrylate, and copolymers or terpolymers thereof. Other examples of non-extensible or limited extensibility materials include polyvinylchloride (PVC), polyvinylidenechloride (PVDC), polyvinylidenefluoride (PVDF), polytetrafluoroethylene (PTFE), expanded polytetrafluoroethylene (ePTFE), polyvinylbutyral (PVB), poly(methylmethacrylate) (PMMA), polyvinylalchohol, polyethylenevinylalchohol (EVOH). The non-extensible or limited extensibility polymers may include polyesters such as without limitation, poly(ethylene teraphathalate) (PET), polyamides including nylons such as nylon-6, nylon6,6, nylon 6,10, and the like, polyureathanes including segmented polyurethanes with MDI or TDI hard segments and polyethyleneoxide or other soft segments. In addition, the non-extensible or limited extensibility polymers may include cellulosic materials (methylcellulose, ethylcellulose, hydroxyethylcellulose, carboxymethylcellulose, propylcellulose, hydroxypropylcellulose, and the like) and coated cellulosic materials. The film forming materials may also be copolymers containing various combinations of the monomer types listed above. The film forming materials may be blends of different combinations of the polymer types listed above. Polymer blends may also be modified with plasticizers or fillers.

The polymer films of which the diaphonic sound membranes are composed, may be multilayered structures containing any number of polymer film materials laminated, co-extruded, or otherwise bonded together. These multilayer films may also be perforated or non-perforated. Some or all of the layers in multilayered film materials may be composed of polymer blends, and may include added plasticizers or fillers.

A. Acoustic Advantages of the Expandable Bubble Portion

The expandable bubble portion 170 provides an intra-ear canal, acoustically transmissive chamber which vibrates flexibly and does not possess a fixed volume or geometry as in conventional listening devices. Fixed volume resonance chambers have displacements and geometries which result in wave cancellations or reinforcements which cause missing frequencies or ones which are too prominent and which continue to vibrate or "ring" past their actual intended duration at the audio transducer 111. This results in an indefinite or "mushy" bass response, as well as other acoustic frequency degradations.

Without being limited by theory, because the ear canal is open at one end, personal listening device audio transducers have traditionally been evaluated according to their performance relative to the acoustical impedance of air, measured in acoustic ohms according to Ohms Law. Once the audio transducer is partially or wholly sealed into the ear canal, the acoustic impedance of air is no longer applicable, the definitive factor now being the compressibility of air in a fixed volume and the compliance of the tympanic membrane. The confined air mass effectively transmits the displacement of high amplitude transducer excursions to the ear drum. Hence the tympanic over-excursions, vibrational mode aberrations and occlusions described above are evidenced in all conventional prior art personal listening devices and hearing aids to greater or lesser degree. The compressibility of the trapped air need only be less than the compliance of the tympanic membrane in order for the full excursion of the transducer to be impinged upon the tympanic membrane.

The bulk modulus of air (B), a measure of its compressibility, is given by the equation:

$$B=-\Delta p/(\Delta V/V)$$

where $\Delta p$ is the change in pressure and $(\Delta V/V)$ is the percent change in volume. For air at constant temperature, B is close enough to 1 atm that the change in volume is linearly and inversely related to the change in pressure. The displacement of the tympanic membrane is given by the displacement of the speaker diaphragm scaled by a factor, which is the ratio of the compliance volume of the tympanic membrane, including the middle ear and other compliant tissue, ($V_T$) to the sum of this compliance volume and the volume of air in the ear canal ($V_C$): $V_T/(V_T+V_C)$. The compliance volume of the tympanic membrane and inner ear ($V_T$) has been measured to range from 0.2 to 1.4 $cm^3$. The volume of the ear canal between speaker diaphragm and the tympanic membrane ranges between 0.5 and 2.0 $cm^3$. Therefore, the scaling factor, which relates the displacement of the tympanic membrane to the displacement of the speaker diaphragm ranges from 0.09 to 0.73. As an example, a normal excursion of the tympanic membrane is about 400 nm (2000 Hz at 100 dB sound pressure level). By contrast a traditional speaker diaphragm sealed in the ear canal producing 100 dB sound pressure level moves as much as 25 μm (1 mil) and greater. Thus a sealed speaker in the ear canal can cause tympanic membrane excursions ranging from about 2.3 to 18 μm, or between 5.6 and 46 times as large as the normal excursions of the tympanic membrane under ambient sound conditions. These over-excursions of the tympanic membrane lead to a loss of hearing sensitivity both immediately and over the long term, and can result in hearing loss.

Embodiments of the device 101 protect the listener from over-excursions of the tympanic membrane by containing the high amplitude pressure waves of the speaker in the vibrating diaphonic bubble. The bubble then re-radiates this sound as a pulsating sphere with wave amplitudes more suited to safe and more highly discernable detection by the tympanic membrane. Part of the energy or sound vibration emanating from the diaphonic bubble or ear lens is transduced directly through the expandable membrane to the ear canal wall, resulting in a tissue and bone conduction perception of sound which bypasses and does not over-modulate the tympanic membrane. This resulting transduction of sound through the listener's head to the cochlea simulates the tissue and bone conduction which naturally occurs when listening to external sound sources such as live music concerts which surround the head with conductive sound pressure waves. Alternately, this sound transduction method can also be actively inversed as noise canceling wave forms which afford greater sound isolation from ambient or environmental tissue and bone conductive sound.

The mechanical properties of expandable bubble portion 170 allows for a continuously changing sound vibration chamber volume and geometry during device operation in which specific internal wave reflection geometries which would lead to standing waves (resonant conditions) or phase cancellations are not consistently present, therefore reducing or eliminating the aforementioned wave cancellations and reinforcements which degrade the frequency response of fixed enclosure chambers. This enhances the acoustic reproduction quality of all audio frequencies, and is especially noticed in lower frequencies where "bass response" is much more definite or "tighter".

The average displacement of the sound-vibration chamber formed by the expandable bubble portion 170 is also much larger than the volume afforded by the ear bud or other listening device plastic housing resonance chamber (back of 110 in FIG. 1) used in conventional practice, which results in a deeper, richer bass response.

Resonance is achieved in the expandable bubble portion 170 across the entire audio frequency spectrum (bass, midrange and high frequencies) without the energy dissipation found in fixed volume enclosures. Fixed enclosures such as the wooden cabinets on the backs of conventional acoustical speakers tend to absorb and dissipate the midrange and high frequencies due to their rigid and relatively massive construction. Disproportionate resonant reinforcement in conventional resonance chambers usually occurs in the bass frequency region. In contrast, the structure of the expandable bubble portion 170 allows for resonance reinforcement of less penetrating, higher frequencies in the midrange and high frequency regions of the spectrum. Unlike conventional diaphragm and fixed enclosure configurations (conventional box speakers as well as personal listening device ear buds), the expandable bubble portion 170 simultaneously functions as both a variable impedance matching resonance chamber as well as a vibrating extension of the audio transducer, and thus resonance and output of acoustical signals are simultaneously achieved in an integrated element. Because the expandable bubble portion 170 also resonates in close proximity to the listener's tympanic membrane 182, more perceivable volume is produced in an appropriate manner than in conventional ear bud configurations per unit of electrical power supplied to the device. This is important for all in-ear applications where battery power is limited, but is particularly important to applications such as hearing aids where the device is used continuously.

B. Resonance Containment

Expandable bubble portion 170 may also serve to contain excess resonance within the ear canal which is typical of existing earbud devices. Containment of audio transducer resonance within the impedance matching expandable bubble portion 170 allows the ear to listen to something else resonate. This more closely duplicates the properties of natural ambient sounds, all of which depend for their resonance on articles or chambers external to the listener's ear. Expandable bubble portion 170 contains and restricts resonances emanatory from audio transducer 111 within the bubble portion itself, rather than transmitting them into an artificial closed resonance chamber unsuitably created at the front of the ear canal, as in conventional technology. This resonance containment thereby emulates the properties of natural ambient sound and affords greater discernability of audio content to the listener. When the ear canal is vented by partially deflating the expandable bubble portion 170, the loss of bass frequency response normally associated with the venting of conventional ear devices is mitigated by resonating bass frequencies within the bubble portion 170 in close proximity to the tympanic membrane 182.

C. Intra-Canal Fit

When disposed in the ear canal, the resonance achieved in the polymeric expandable bubble portion 170 does not result in vibrations which irritate the ear due to the properties of the expandable bubble portion 170 described above. The inflatable membrane may be capable of being pressurized in the canal with extremely low pressure levels (which are also adjustable by the listener during operation), which may result in minimum impingement on the sensitive ear canal tissue and therefore a variable acoustic seal is achieved while maintaining optimum comfort and compliance to the normal deformations which occur in the ear canal when the listener's jaw is opened and closed. This is difficult, if not impossible with conventional ear molds or plugs, which are notorious for causing pain and losing their acoustic seal, resulting in loss of fidelity in ear buds and also feedback in hearing aids. The variable acoustic seal afforded by inflating the resonant membrane 170 in the ear canal not only sounds better, but because of the comfortable fit, it can be worn without the pain or tissue inflammation attendant to conventional devices. In an embodiment, the resonant membrane is hypoallergenic. As described above, air masses may be continuously diffused from pores in the expandable bubble portion wall 71 provide a variable air cushion for the expandable bubble portion 170, work to equalize intra-canal air pressures and temperatures with ambient environmental conditions, and allow for a user adjustable acoustic seal and user adjustable impedance matching.

D. Intra-Canal Operation and Wave Propagation of the Expandable Bubble Portion

The expandable bubble portion 170 presents a much larger surface area for coupling of vibrational sound energy into the listener's ear or into the surrounding air than does a simple transducer 111. Operating on the same overall electrically transduced power, this results in smaller membrane excursions than those which occur at said diaphragm 111. Additionally, the expandable bubble portion 170 couples sound vibrations not just down the ear canal but also by potential contact at the ear canal wall, according to the listener's preference. This results in bone and tissue audio conduction which enhances the listening experience.

The manner in which sound is produced by the expandable bubble portion 170 in the listener's ear canal is extremely significant and novel. When coupled to the canal, conventional hearing aid, ear bud, and headphone transducers produce unnatural vibrational modes in the tympanic membrane, in addition to perceivable sound. These alteration have adverse effects on the normal operation of the listener's tympanic membrane 182, and significantly reduce sound clarity and discernibly. Just as the pressure differentials occurring between the Eustachian tube and the ear canal when flying or traveling in the mountains hold the ear drum still and reduce the listener's ability to hear (until the ears are "popped"), the aforementioned vibrations alterations introduced by conventional transducers coupled to the ear canal likewise tend to dampen the delicate vibration movements of the ear drum in a manner which is directly proportional to the volume levels being introduced. In other words, as volume is increased, greater vibrational aberration is introduced, which results in significantly lower fidelity and discernability. The resonance chamber which exists within the expandable bubble portion 170 contains these vibrations and transmits sound in a manner to which the ear drum is more accustomed and sensitive. As described above, the human ear is extremely receptive to the resonances which occur in resonating bodies in the surrounding environment such as the sound "boxes" or resonating columns on guitars and all other acoustic instruments, the voice "box" (which resonates in the mouth, the pharynx and the chest), the "chambers" which comprise the rooms or outdoor areas in which we live, etc. The conventional practice of coupling transducers directly to the ear canal is tantamount to conducting guitar string vibrations directly to a sound box made out of the ear canal itself instead of to the guitar's own sound box via the sound board bridge: the delicate operation of the ear drum is overwhelmed, and space necessary for optimum discernment is deleted and bypassed. The delicate mechanisms of the ear are reduced to the gross mechanical excursions of the audio transducer.

In embodiments, acoustically generated turbulences are contained within the expandable bubble portion 170, and its passive vibrations radiate and are disbursed from a larger surface area than that normally provided by the audio transducer 111. The surface vibrations transmitting sound from the expandable bubble portion 170 involve membrane excursions which are significantly smaller than those which occur at diaphragm 111, and thus sounds transmitted by the expandable bubble portion 170 result in smaller excursion of the tympanic membrane. This results in less listener ear fatigue and greater audio discernability. Unlike typical ear bud transducers which cause significant hearing or audio fatigue after a short time, the expandable bubble portion 170 can be listened to for greater periods or indefinitely, depending on the individual, at normal levels without fatigue and it is therefore more suitable for hearing aid wearers as well as those whose occupations involve extensive use of personal listening devices.

Unlike conventional ear molds, ear plugs, ear buds, and headphones, the expandable bubble portion 170 may admit ambient sound from the environment. The variable acoustic seal formed by the bubble portion 170 and the thin, compliant membrane from which the bubble portion 170 is made of allows the listener to hear and safely interact with persons, vehicles, machines, traffic, etc, in his environment, while also listening to audio information being transmitted by the transducer. Also, at higher transducer volume levels, the acoustic seal afforded by the expandable bubble portion (e.g. sound bladder) isolates the audio transducer's transmissions enough to allow placement of high quality stereo microphones on the outside of the transducer casing, permitting the amplification and proper electronic mixing and placement of environmental ambient sounds together with the music or communications audio being played by the device. These same environmental sounds when electronically phase-reversed, allow the delicate inflatable membrane to act in a noise-canceling mode which affords varying degrees of effective sound isolation without the use of a heavy insulating mass. This noise cancellation can be effectively transduced from the pulsating bubble through the canal wall and directly to the cochlea thereby cancelling out ambient environmental bone-conducted sound.

E. Other Embodiments

It is envisioned that embodiments of the expandable sound-vibration-driven membrane may also comprise permeable membranes and impermeable or non-perforated membranes, which will provide utility for differing purposes. Impermeable membranes may be especially suitable to pre-inflated, pre-pressurized resonant membrane embodiments such sound mitigating or water blocking earplugs which can also be used to couple or isolate audio sounds incorporating various of the aforementioned advantages, according to construction parameters.

Additional embodiments may comprise a plurality of pressurized, expandable bubble portions placed in differing positions relative to the tympanic membrane may be driven by singular or multiple audio transducers to provide for 3 dimensional sound imagery in or around the ear. Combining a plurality of pressurized chambers, may also have utility in both sound transmission/transduction and sound cancellation applications.

The acoustic and mechanical properties of the expandable bubble portion may render it suitable to being driven, pressurized and expanded from remote locations through the use of a long, malleable sound and pressure delivery tube 160. Unlike conventional ear mold or ear plug embodiments in which audio frequencies are dissipated and degraded in direct proportion to the length of the tube being interposed, the expandable bubble portion 170 effectively refracts a full range of audio frequencies over longer tube distances. This affords the placement of traducers at locations behind the ear or even on the audio connection cord or communication and or audio media playing device and substantially lessens the mass and weight of the in- or on-ear portion.

Expandable bubble portion 170 may comprise any suitable shape or geometry. For instance, expandable bubble portion 170 may comprise three dimensional shapes including without limitation a spheroid, a prolate spheroid (football-shaped), oblate spheroid, a torus, a frustum, a cone, an hour glass, and combinations of the above. Such shapes may be, both intra-canal and supra-auricle, respectively and together. Additional shape embodiments include indefinite-form-fitting; tubular; ear canal shaped; auricle shaped; auricle shaped in relief; toroidal (doughnut shaped, presenting audio transducer 110 directly to the ear canal as well as pressurizing and resonating the expandable bubble portion).

It is also contemplated that the use of ambient porting to the air and sound may be external to the ear canal though one or more orifices in the body of the expandable bubble portion. For frequency specific hearing impairments or applications wherein minimal occlusion of the ear canal is required such as military or work related environments, the bubble portion 170 may be in the shape of a torus (donut) or other inflated shape with singular or multiple porting holes of varying size.

In an audio transductive/transmissive embodiment, involving both bone and tissue audio conduction as well as acoustic transmission, expandable bubble portion 170 may be placed at the end of an extended or elongated sound and pressure tube. Alternately, expandable bubble portion 170 may surround the audio transducer partially or completely, with and without porting. In another embodiment, a resonant tube may surround the head of a user as in a hat band (or a plurality of tubes, transmissive of multiple channels of an audio signal).

Alternatively, a resonant tube may surround the neck as in a necklace or collar (or a plurality of tubes, transmissive of multiple channels of an audio signal). In further embodiments, resonant tube may surround all or part of the auricle, as in (or a plurality of tubes, transmissive of multiple channels of an audio signal) eyeglass frame temples or facemask straps.

Expandable bubble portions may be draped or surround the shoulders in a manner similar to shoulder pads. In other embodiments, both intra-canal and supra-auricle expandable bubble portions may be combined along with embodiments of expandable bubble portions surrounding the user's body.

In an embodiment, expandable bubble portion 170 may be pre-pressurized by the user's breath during use via pressure tube with or without reservoir. Moreover, pressure may be created by breathing into a facemask (above & under water). In another embodiment, pre-pressurization may occur through a chemical reaction. A reservoir of pressurized acoustically conductive gas or liquid may be in fluid communication with expandable bubble portion 170. The medium with which the expandable bubble portion 170 may be expanded may be a temperature dependant expanding gas or any combination of resonant gases or liquids.

Figure 5:
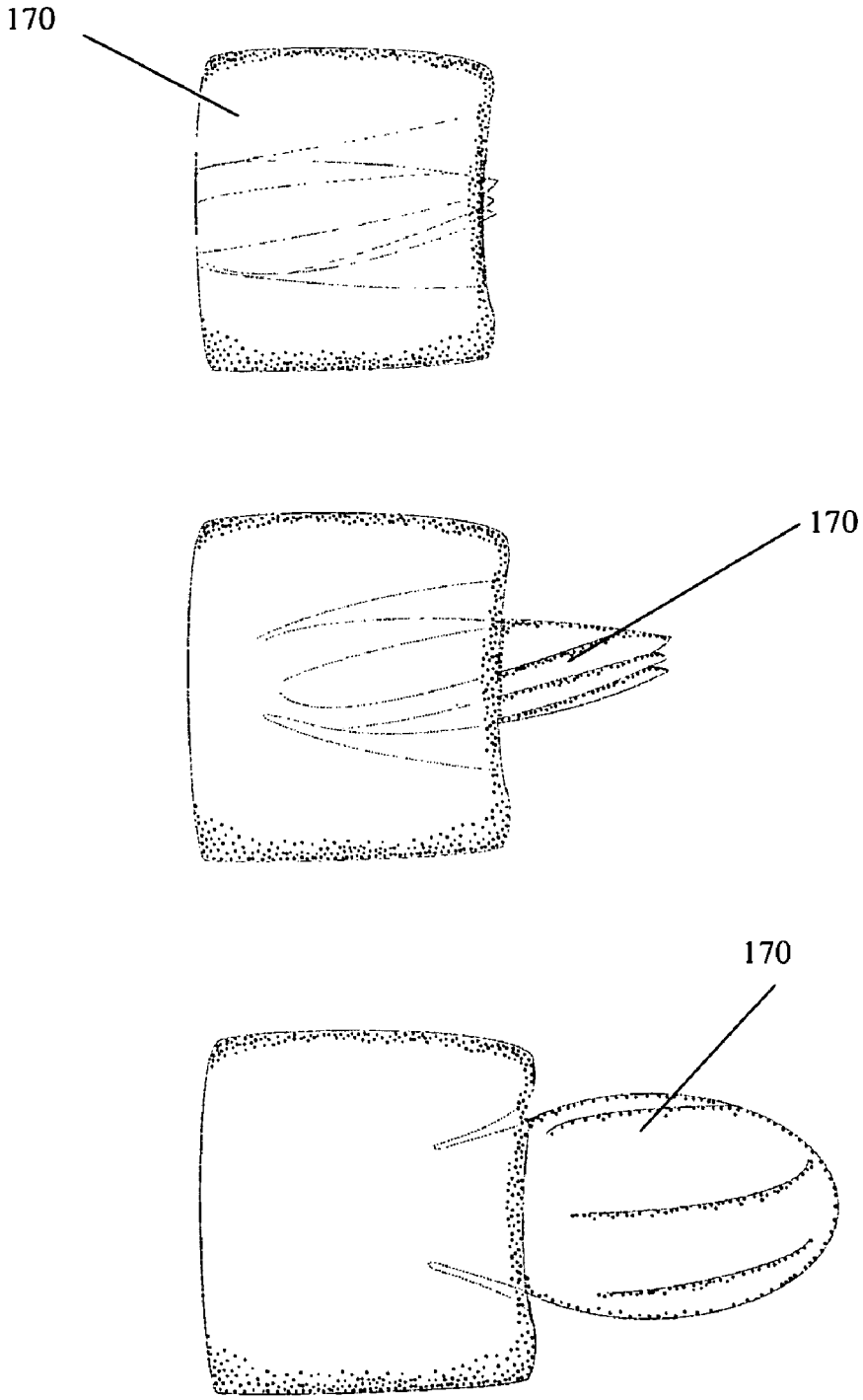
FIGS. 5A-C illustrates the stages of a pleated embodiment of expandable bubble portion of acoustic device.

In further embodiments, flexible polymer film materials with limited or no extensibility (e.g. inelastic) may be adapted for use as material for the bubble portion 170 through various mechanical pleating, folding and wrinkling schemes. The high modulus of deformation presented by a material's lack of extensibility may be mitigated by utilizing the material polymer film's bending modulus, which is very low for the thin films useful for diaphonic sound membranes. Just as a non-extensible parachute is folded and packed in a manner which allows it to be stored, opened and easily "inflated" when subjected to sufficient air flow, diaphonic sound lens membranes may be mechanically pleated, folded and/or wrinkled in a similar or other manner so as to limit initial size for purposes of storage and easy insertion into the ear canal, as shown in FIGS. 5A-C. Once inserted, bubble portion 170 allows for inflation to the size and surface properties necessary to a comfortable and variable acoustic seal, as well as the impedance-matching and transduction functions above.

The inflation resistance of the polymer film is dictated by its bending modulus together with the designed topography of the pleating, folding and/or wrinkling schemes utilized. In addition to allowing the diaphonic ear lens to adapt to ear canals of different sizes, this configuration also determines its frequency transmission characteristics, impedance-matching or "loading" of the speaker and ear drum performance, as well as its sound disbursement and refraction or channeling characteristics. Additionally, it also determines the durometer or surface tension of the membrane as well as its comfort and ability to maintain a desirable and variable acoustic seal, thereby allowing it to flex easily and maintain proper conformation when the canal is flexed or distorted through jaw movement.

The size, pattern and placement of pores in the membrane wall determine various desirable acoustic transparencies or impedances, and their appropriate configuration is interdependent with the various mechanical pleating, folding and wrinkling schemes in application. The acoustic transduction (bone conduction) properties also described and available through the use of flexible membranes and materials are also achievable through optimization of all of these factors. Using these and other parameters of the invention, prescriptive medical embodiments may be configured and sold, based on proper medical diagnosis of the user's hearing and physiology.

Figure 9A:
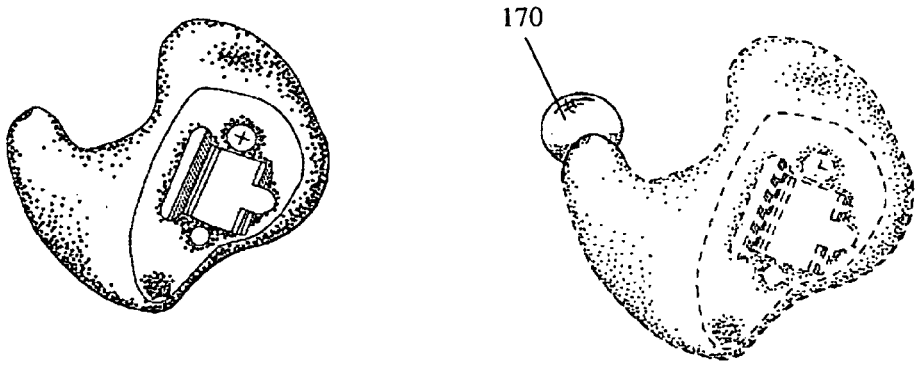
PRIOR ART FIGURE 9A
FIGS. 9A-B shows two types of hearing aid without and with an embodiment of the acoustic device.
Figure 9B:
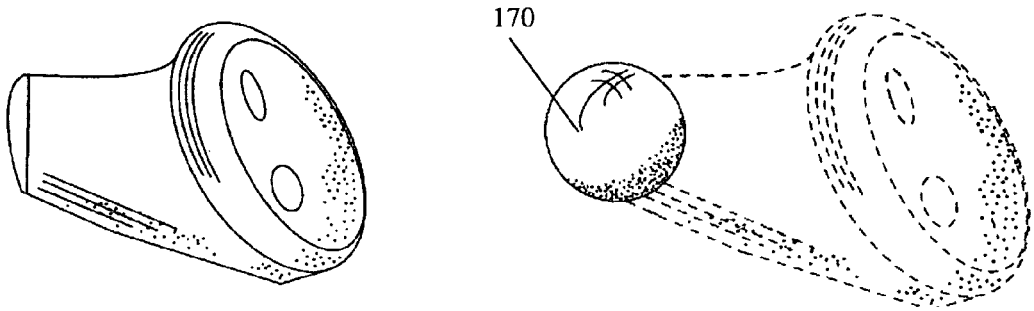
PRIOR ART FIGURE 9B
Figure 10:
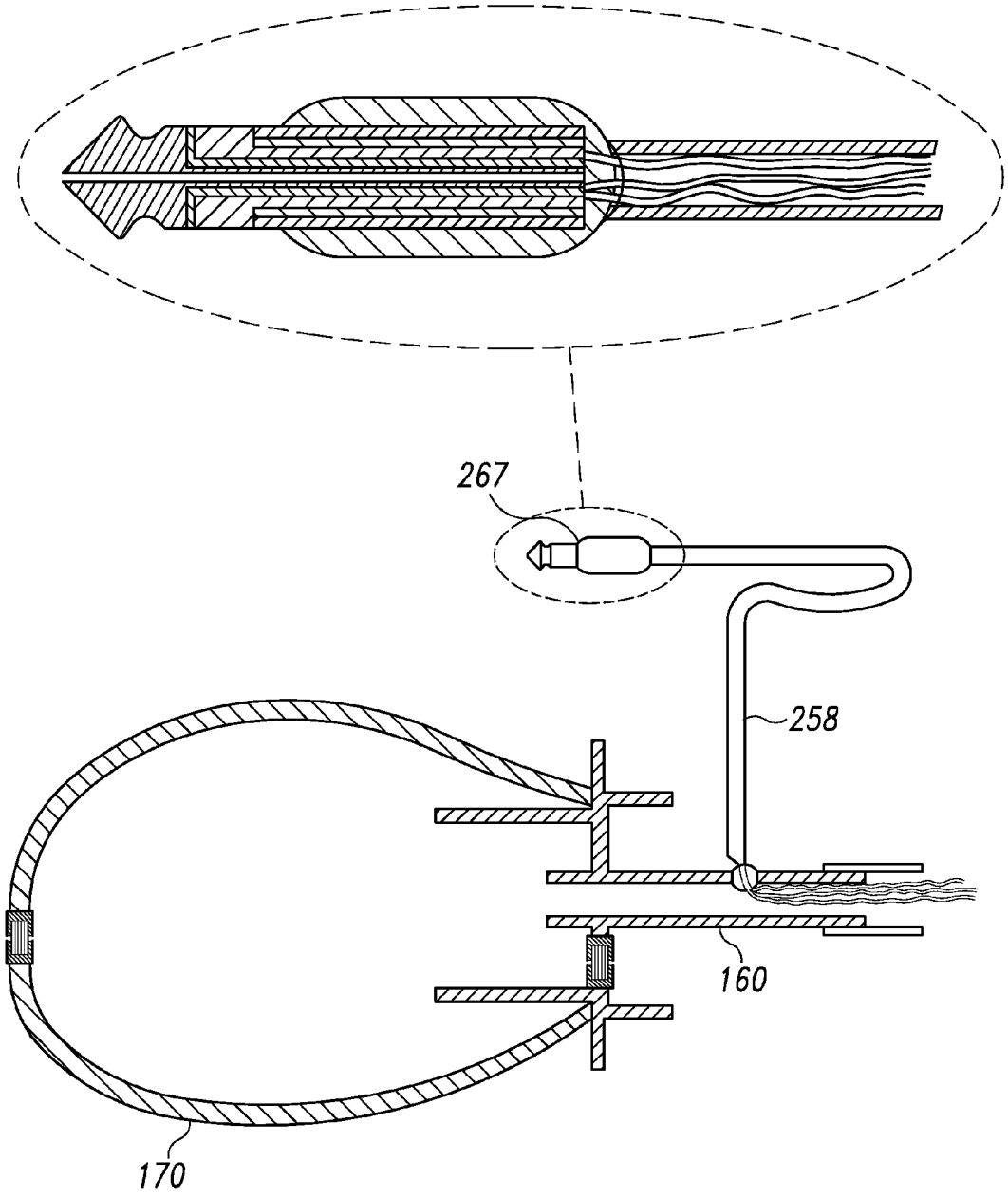
FIG. 10 illustrates a cross-section of a manual pump with hollow plug including a close-up of a pressure transmitting plug that may be used with embodiments of the diaphonic member.

According to other embodiments, expandable bubble portion 170 may be coupled to existing acoustic devices known in the art such as shown in FIGS. 9A-B. The expandable bubble portion 170 may be, for example, fabricated so as to be coupled to devices such as commercially available in-ear hearing aids.

A combination of elastic and inelastic membranes with or without pores may be used for various applications, including but not limited to membrane inflation in-ear presentation and retraction schemes, multi-chambered/multichannel audio transmission and transduction schemes, membrane protection schemes, speaker or ambient sound transparency or isolation schemes, cerumen mitigation schemes, pressure/temperature equalization schemes, and schemes formulated to accommodate placement of the speaker fully within or adjacent to the extensible membrane.

II. The Diaphonic Assembly

Figure 2:
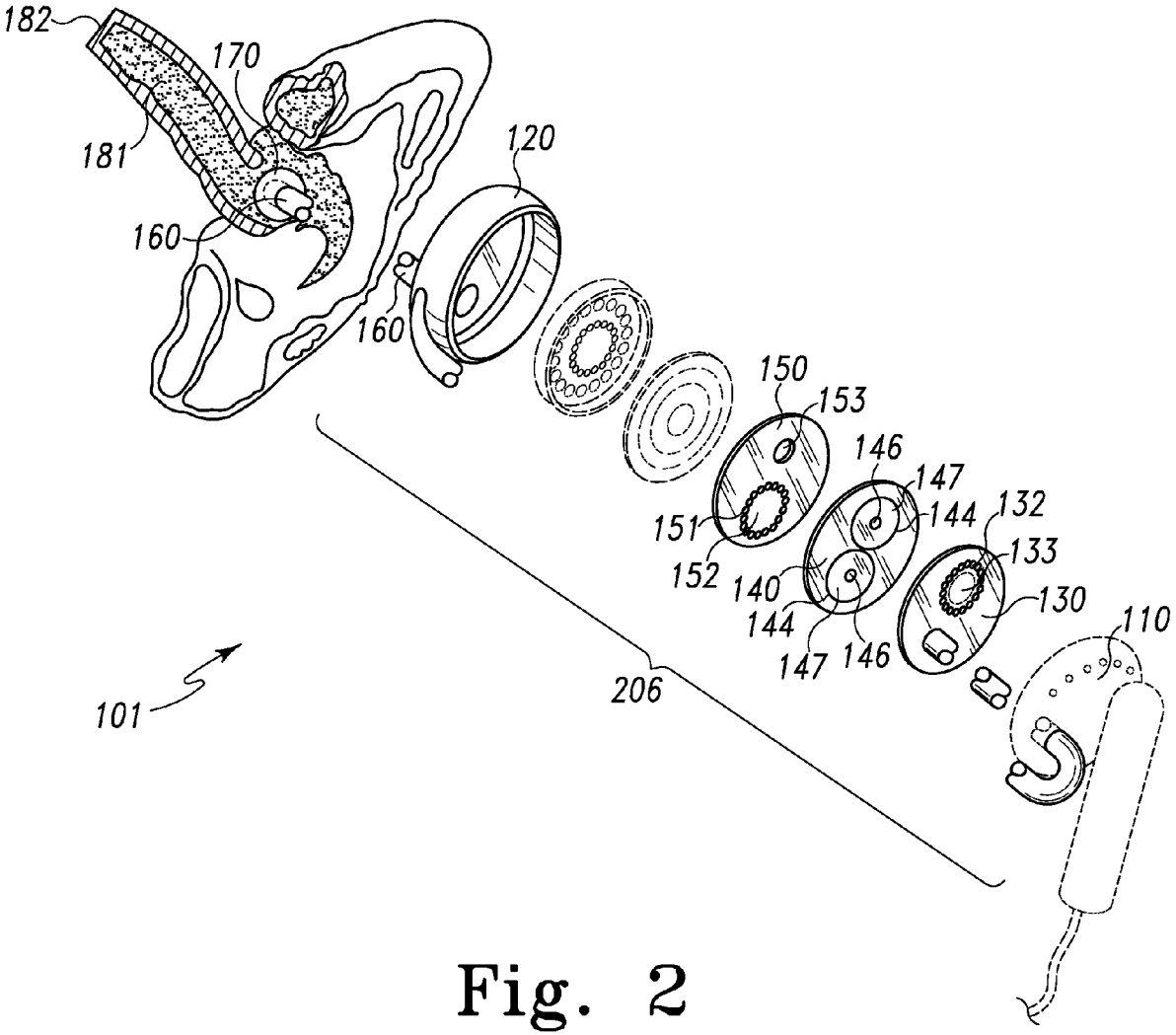
FIG. 2 is an exploded perspective view of a rear-mounted diaphonic valve assembly and an expandable bubble portion assembly.

Referring to FIGS. 1-2, diaphonic assembly 103 includes a housing 120 which encapsulates a valve sub-assembly 102 and retains it in a rigid, acoustically and atmospherically sealed state through a seal 122 constructed on the outermost interior wall of said housing 120. In one embodiment, housing 120 is a collar or a ring. In FIG. 1, housing 120 is disposed distal to valve sub-assembly 102. Alternatively, housing 120 may be disposed proximal to valve sub-assembly 102 as shown in FIG. 2. A valve sub-assembly 102 is coupled near the surface of an ear bud audio transducer diaphragm 111 in a rigid but preferably removable manner by elastic seal 121 which surrounds the perimeter of said audio transducer 110. An example of a suitable audio transducer 110 is described in U.S. Pat. No. 4,852,177, issued Jul. 25, 1989, entitled High Fidelity Earphone and Hearing Aid, by Stephen D. Ambrose, which is herein incorporated by reference in its entirety for all purposes.

Figure 3:
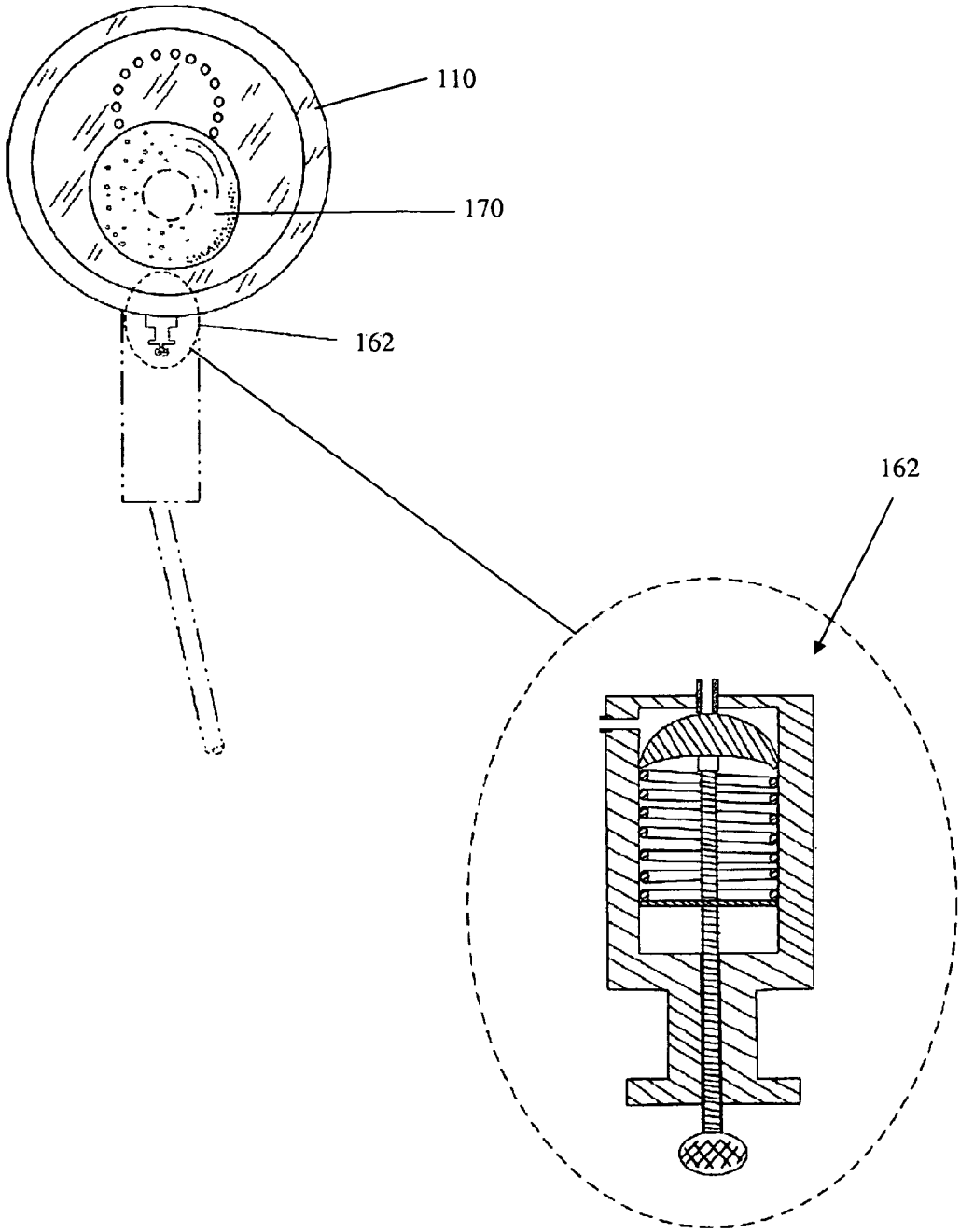
FIG. 3 is an orthogonal front view of a diaphonic valve assembly and an expandable bubble portion assembly and a sectional view of an adjustable threshold relief valve.
Figure 4:
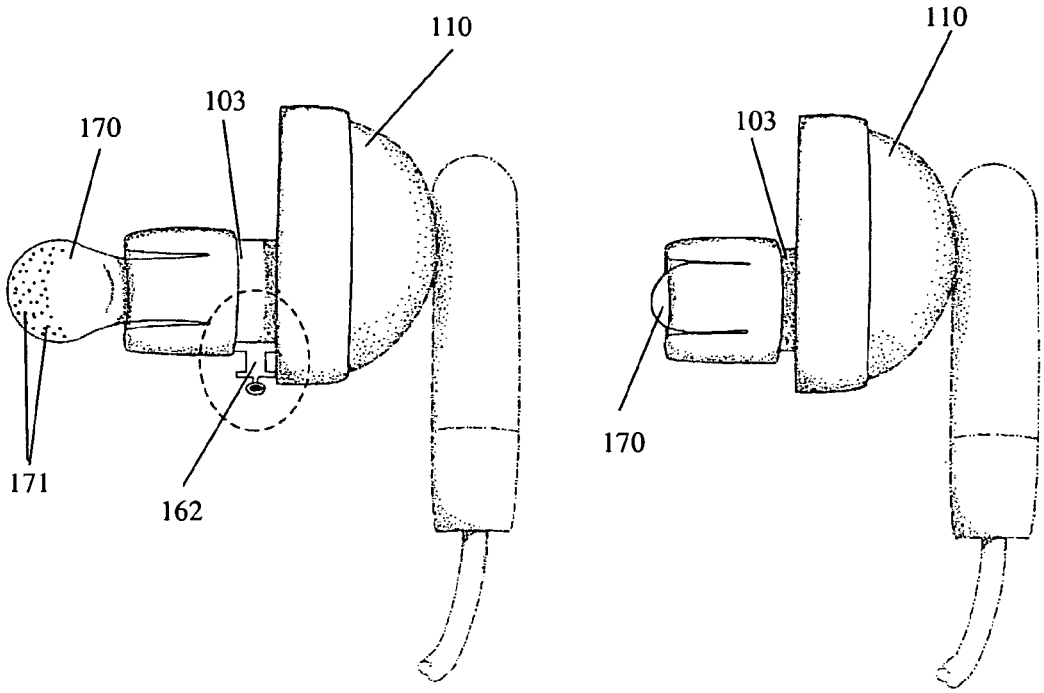
FIG. 4 illustrates an iPod® ear bud with a expandable bubble member in a protective sheath as a collapsed laterally pleated membrane.

Valve sub-assembly 102, which is part of diaphonic assembly 103, may be composed of one or more laterally stacked substrates containing functional elements in a specific alignment. In an embodiment, the substrate assembly 102 may comprise at least three substrates. The substrates may comprise a distal substrate 130, a medial substrate 140, and a proximal substrate 150. Both the distal and proximal substrates 130, 150 may serve as sound and pressure porting substrates. As shown, medial substrate 140 may be disposed between distal and proximal substrates 130, 150. Substrates may work in concert to refract and transmit acoustic frequency vibrations. In addition, substrates may compress, pump and channel elevated pressures generated by the audio transducer 110 down a sound and pressure delivery tube 160 into an inflatable and breathable diaphonically resonant in-ear membrane 170. This allows the pressure generated by the transducer diaphragm 111 to pressurize the expandable bubble portion 170 as well as acoustically modulating it in a manner that individually impedance matches both the transducer diaphragm 111 and a listener's tympanic membrane 182. This impedance matching for both the transducer diaphragm 111 and the tympanic membrane 182 occurs optimally at different levels for each, being easily adjustable by the user, while wearing and using the device, by means of electronic adjustment of a superimposed inflation-pressure generating waveform, generated by the transducer 111, and an adjustable threshold relief valve 162 (as shown in FIG. 3).

Relief valve 162 may comprise any suitable valve known to those of skill in the art. For example, as shown in FIG. 3, relief valve 162 may be a spring release valve. Relief valve 162 may be coupled to diaphonic assembly 103 or to audio transducer 110. The inflation-pressure generating waveform can be sub-audible and can be simultaneously superimposed over the music, voice, or other program material being played by the audio transducer 101. When enclosed by housing 120, substrate assembly 101 forms the diaphonic assembly 103.

As described above, valve sub-assembly 102 comprises one or more substrates. The one or more substrates together may form an ingress valve and an egress valve. In embodiments, ingress and egress valve may each comprise a diaphragm membrane 147, a valve seat 152, 133, and ports 132, 151 (and ports 131, 153), respectively. Each component of these valves may be disposed on a substrate. Operation of the ingress and egress valves will be described in more detail below.

Figure 6:
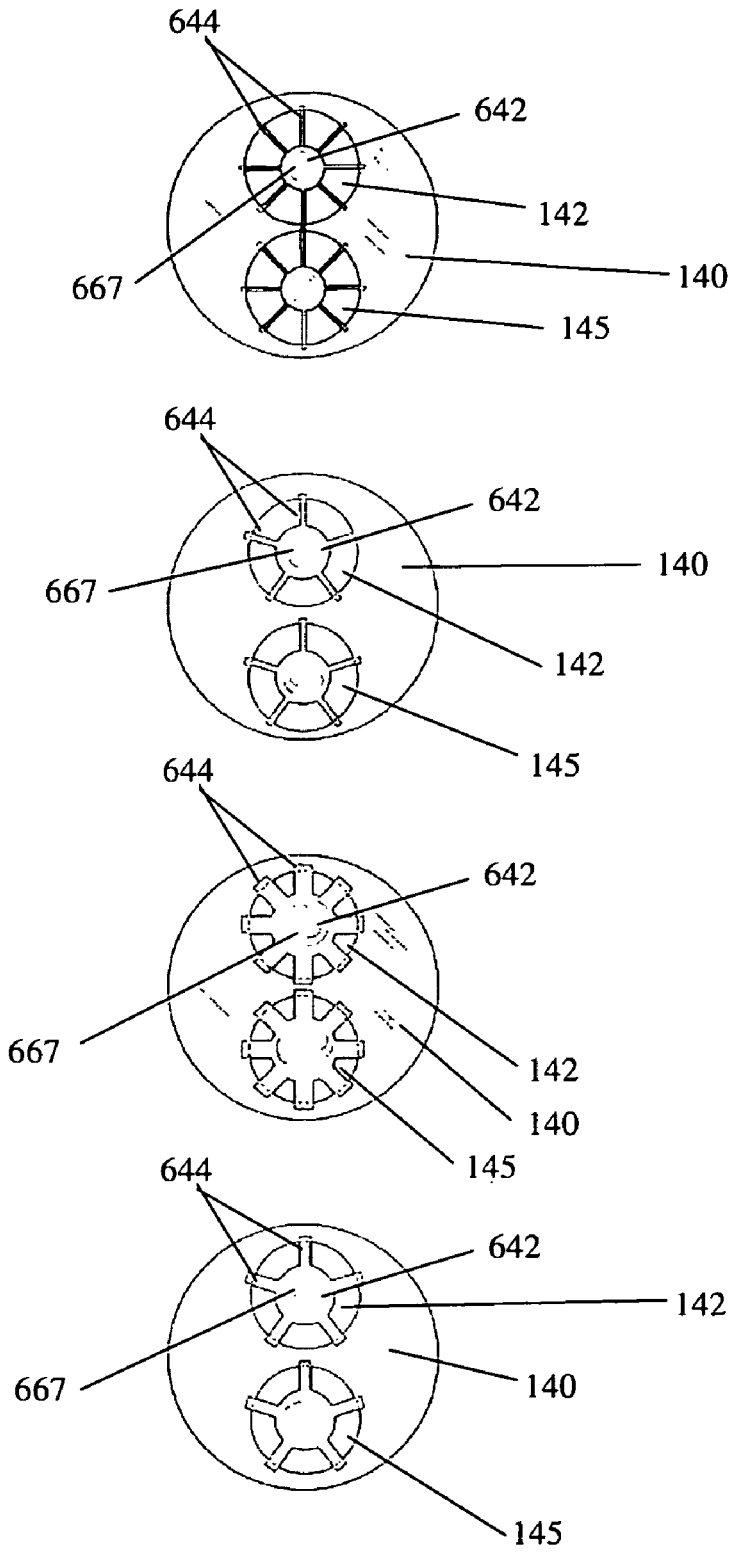
FIG. 6 is an orthogonal front view of an assortment of diaphonic valve substrates with ingress and egress port orifice patterns.
Figure 7:
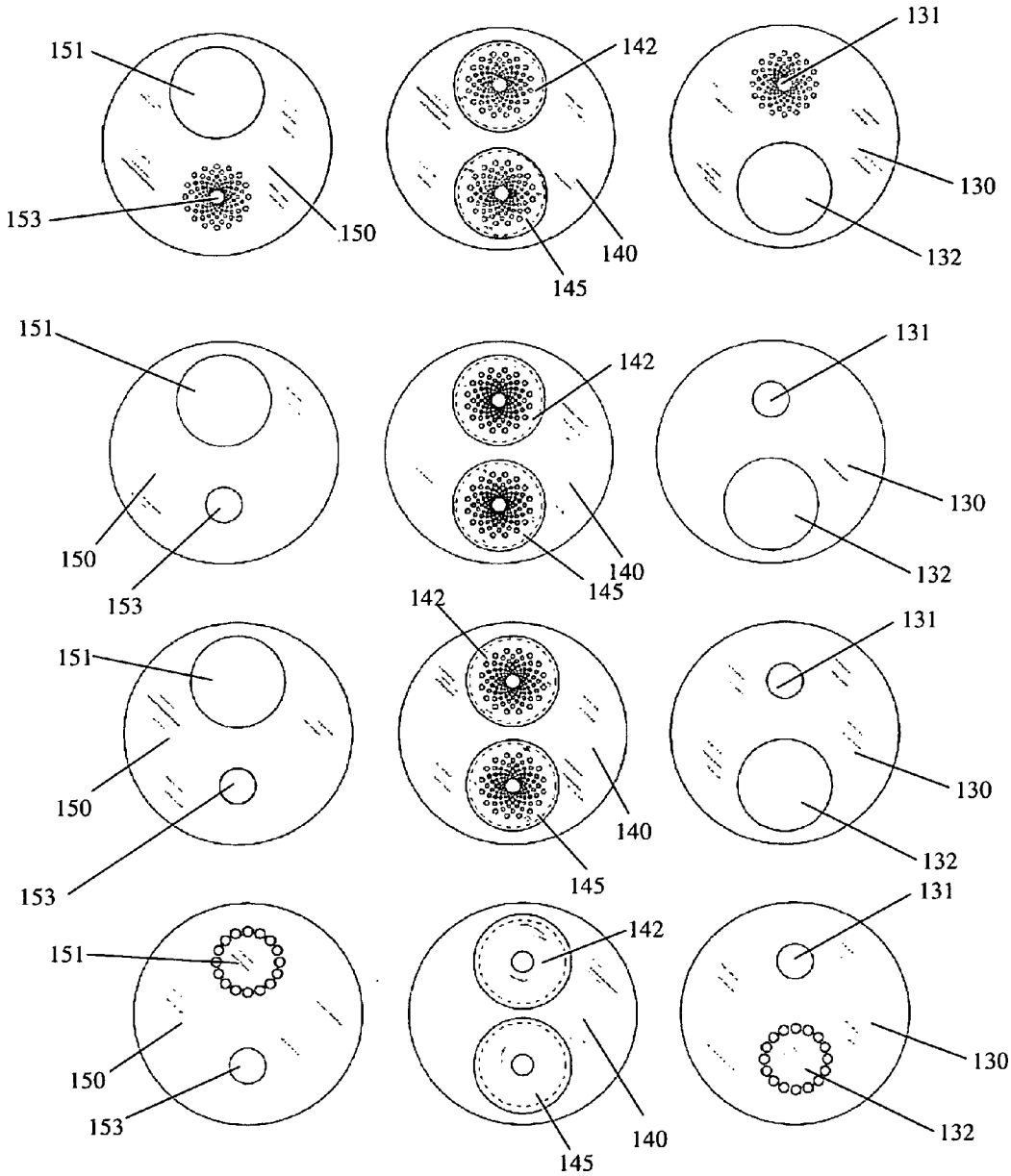
FIG. 7 is an orthogonal front view of a further assortment of diaphonic valve substrates with ingress and egress port orifice patterns.
Figure 8:
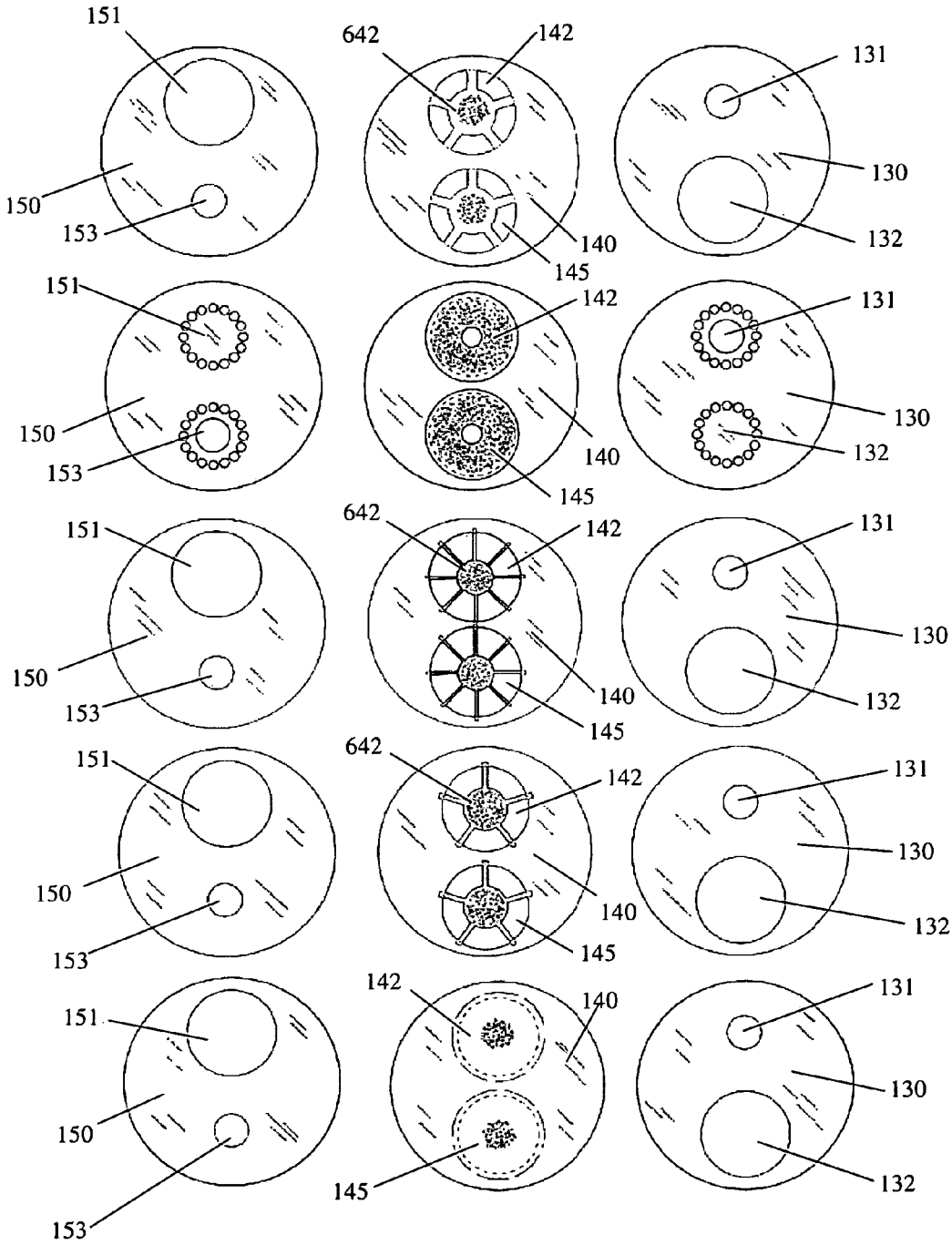
FIG. 8 is an orthogonal front view of an another assortment of diaphonic assembly substrates with ingress and egress port orifice patterns together with porous patterns in the diaphonic valve membrane wall.

The distal substrate 130 (i.e. sound and pressure porting substrate) may comprise a substrate disk possessing an ambient-air, ingress-pressure, diaphonic valve, monoport 131, an inner array of ports or orifices 132 for relieving egress-pressure and an outer array of ports or orifices 133 for relieving egress-pressure. FIG. 1 shows a perspective view of substrate 130. Without limiting the device to these examples, other possible port and valve configurations for substrate 130 which could be used are also shown in FIG. 6-8. Orifices or ports 131, 132, and 133 may be held under seal and in close proximity to the audio transducer 111 by the housing 120, and may lie within the range of acoustic vibrations and pressure changes produced by the diaphragm 111 of the audio transducer 110. These pressures and vibrations are transmitted via the substrate port orifices 131 and 132 to the diaphonic valve diaphragm frame and membrane substrate 140.

The medial substrate 140 is shown in greater detail in FIG. 6, and may comprise a substrate disk having one or more diaphragms 142, 145. In an embodiment, an ingress diaphragm 142 is affixed to rim 141. In the center of diaphragm membrane 142 is ingress pressure port 143. The medial substrate 40 may also include an egress pressure diaphragm 145 affixed to a rim 144. In the center of the diaphragm membrane 147 is an egress port 146. Diaphragms 142, 145 may each have one or more ports. Pores in the diaphragm membrane 147 may surround ports 143, 146, and may be arranged in patterns, as shown in FIGS. 6-8, which enhance acoustic refraction, vibration, dynamic range and generated pressure. A wide range of microperforation patterns have utility in this application. These pores 147 may also vary in number, size, density and location, according to intended design and properties desired. Examples of these patterns are illustrated in, but not limited to, FIG. 7.

The medial substrate 140 may be coaxially aligned and coupled to proximal substrate 150. Proximal substrate 150 may comprise an array of ports or orifices 151, which provides a path by which ambient air pressure can enter, and an ingress-pressure, diaphonic-valve-seat 152 by which this path to ambient air pressure can be blocked. Substrate 150 may also possess an egress-pressure port 153 which transmits pressure toward the expandable bubble portion 170. FIGS. 1-2 show a perspective view of the substrate 150. Without limiting the device to these examples, other possible port and valve configurations for substrate 150 which have been found to be of utility are also shown in FIGS. 6-8. FIG. 6 shows the many different examples of gratings 642 which may cover the diaphragms 142, 145 of medial substrates. The gratings 642 may change the sound transmission to expandable bubble portion 170. Specifically, each grating 642 may be in a star pattern having from 2 to 8 arms 644 extending from a central portion 667. Grating 642 may be made of any suitable material and may comprise the same material as expandable bubble portion 170.

The diaphragms 142 and 145 may be aligned coaxially with the adjoining substrate port orifices 131 and 132, and 151 and 153 respectively. These diaphragm membranes 142 and 145 transmit and refract acoustic vibrations generated by the audio transducer 111. In addition, diaphragm membranes 142 and 145 may be fabricated from an elastic, polymeric material with properties as described below. The acoustic vibrations and pressure changes which are transmitted via the port orifices 131 and 132 impinge upon the diaphonic valve diaphragm membranes 145 and 47, causing them to vibrate and move sympathetically, effectively refracting and transmitting sound and pressure through to the port orifices 151 and 153 on the posterior substrate 150. The orifices or openings in 130 and 150 (131, 132, 151, and 153) may be arranged in patterns which enhance acoustic refraction, vibration, dynamic range and generated pressure. A wide range of patterns have utility in this application. These patterns may also vary in number, size, density and location of the holes, according to intended design and properties desired. Examples of these hole-patterns for plates 130 and 150 are illustrated in, but not limited to, FIGS. 7 and 8.

Diaphonic assembly 103 may provide several modes of operation to inflate sound-vibration membrane 170 which are described below. The modes may be performed simultaneously or serially.

A. Diaphonic Pressure Pumping Mode:

In this mode, pressure generated by excursions of the audio transducer 111 (especially at low frequencies) is transmitted by said diaphonic assembly to pressurize and inflate the expandable bubble portion 170. The variable pressurization of the expandable bubble portion 170 via the pumping mode of valve assembly 103 may allow for control of independent impedance matching, intra-canal refresh rates and air cushioning, intra-canal air mass pressure and temperature equalization, a variable acoustic seal as well as audio transmission characteristics. Unlike conventional diaphragm valves, said diaphonic assembly consistently transmits acoustic vibrations regardless of the sealed or open status of the ports 131, 132, 143, 146, 151, and 153.

The pumping operation of the diaphonic assembly 103 works by capturing the positive pressure, or push, of the audio transducer 111 to inflate the expandable bubble portion 170, while partially venting in ambient air pressure 191 to alleviate the negative pressure or pull of the audio transducer 111. Diaphragms 142 and 145 may both undergo incursions and excursions in tandem, or in phase, with those occurring in the transducer 111. During excursions or pushes from the audio transducer 111, the egress diaphragm 145 is pushed off of its valve seat 133, thus opening a path through 132, 146 and 153 and allowing pressure from the audio transducer to travel on through the sound and pressure delivery tube 160, which is affixed to the outlet of 153 by the sound and pressure delivery tube collar, toward the expandable bubble portion 170. Pressure in the bubble portion 170 is regulated, and can be released, through pores 171 in the expandable bubble portion wall and through the adjustable threshold relief valve 162 (shown on FIG. 3). Simultaneously, during excursions or pushes from the audio transducer, the ingress diaphragm membrane 142 is pushed into contact with the valve seat 152 thereby preventing loss of pressure to the ambient outside air. During incursions or pulls from the audio transducer, the ingress diaphragm membrane 142 is pulled out of contact with the valve seat 152 thus allowing ingress of outside air through 151, 143, and 131, thereby partially relieving the negative pressure of the pull side of the audio transducer 111 vibration. Simultaneously, during incursions or pulls from the audio transducer 111, the egress diaphragm membrane 145 is pulled into contact with the valve seat 33, preventing escape of the pressure in the expandable bubble portion 170.

User controlled inflation, pressurization and impedance matching of expandable bubble portion 170 is achieved through a superimposed inflation-pressure generating waveform which is electronically mixed into the music, communication or program material being listened to by means of said ear bud audio transducer 110 and is regulated as to waveform shape, amplitude and frequency according to the user's intended results. An electronic feedback circuit which senses the impedance loading of said ear bud audio transducer 110 may also be employed for automatic control of amplitude and frequency according to programmable preset parameters. Waveform, frequency and amplitude during pumping may be audible or inaudible also according to said intended results. Inaudible low frequency, low amplitude waveforms result in slower pressurization and inflation of the expandable bubble portion 170 and may be used to maintain inflation and impedance matching levels and refresh rates (circulation of new air masses within the membrane 170 and the ear canal) when listening to program material which lacks sufficient frequency content (higher amplitude low and mid range frequencies) to efficiently operate the diaphonic pump.

Higher frequency and amplitude waveforms, although more audible, produce more efficient pumping, effecting rapid pressurization of expandable bubble portion 170 when needed. Said electronic waveforms, superimposed on the audio program material played by audio transducer 110 and diaphragm 111, allow control of the diaphonic pump. This external and user accessible control works in concert with the pores in the expandable bubble portion wall 171 together with the adjustable threshold relief valve 162 to allow the user to easily match their own tympanic membrane impedance during use as well as to control intra-canal fit and comfort, intra-canal air mass refresh rate (controlling intra-canal pressure and temperature), environmental ambient sound isolation or admittance, atmospheric pressure equalization, the amplitude of vibrational displacements of the expandable bubble portion 170, and impedance matching of audio diaphragm 111. Modified waveforms may be implemented to enhance the effectiveness and operation of the superimposed inflation-pressure generating waveform, which is not limited to a sine waveform or the low frequency spectrum. Any waveform (square, triangular, saw-tooth, combinations thereof, or other) imposed on the audio diaphragm 111 which operates the diaphonic pump in a desirable manner may be considered part of the device. Factors influencing the choice of the waveform to be used include user experience (audio content and expandable bubble portion pressurization and inflation rate), and efficiency of pumping, which impacts battery life of the device being used to drive audio transducer 110. In an embodiment, a signature or trademark sound, saying, song or musical phase may be stored digitally in electronic memory or otherwise (such as the Microsoft Windows® or Apple® computer startup sounds or Dolby Digital®, THX® or DSS® movie theater sound system demonstration sounds) which quickly inflates and prepares the expandable bubble portion 170 for use in a pleasing and commercially recognizable manner.

Diaphonic Acoustical Transmission Mode:

In this mode, acoustic vibrations (i.e. voice, music, or other program material) are refracted and transmitted as previously described, and may be simultaneously to or independent of the aforementioned pumping operation and serve several functions. First, the diaphonic assembly 103 may have inversion symmetry around the center point of plate 140. Elements 151, 152, 141, 142, 143, and 131 may be symmetric around this inversion with elements 132, 133, 144, 145, 146, and 153. The symmetry of this offset placement of ingress and egress valves, ports, and diaphragms allows for acoustic vibration of the diaphonic membranes 142 and 145 outside the central areas of the valve seat contact and membrane seating areas. This renders said membranes 142 and 145 transparent to and transmissive of the acoustic vibrational emissions of the audio transducer 111, regardless of the open or closed status of each valve and porting assembly.

Secondly, the membranes 142 and 145 are preferably thinner than frame 140 which holds them. However, membranes 142 and 145 may be of any thickness. In embodiments where plates or substrates 130, 140, and 150 are all laterally stacked in contact, the membranes 142 and 145 preferably still have space to experience lateral displacement during mechanical vibration. The distance between the membrane monoport and the orifice rim, the membrane excursion displacement based on the inherent elasticity in the polymeric membrane and the small spacing between the membranes 142 and 145 and the multiport arrays 151 and 132 also allow for membrane fluctuations which render the entire assembly 103 transparent to and transmissive of acoustic vibrational emissions of the transducer 111.

The motions of membranes 142 and 145 in acoustic vibrations may also result in only partial valve seating of ingress and egress assemblies during simultaneous pumping. Thus the superposition of program material (i.e. acoustical vibrations) with the pumping mechanism results in a reduction in pumping efficiency while at the same time allowing greater transmission of the acoustical vibrations. However, the pressure generated is still sufficient for inflation and operation purposes, but allows for diaphonic membrane transparency to acoustic transmissions from the audio transducer 111 without audible fluctuations in acoustic volume or frequency due to valve pressure pumping operations.

Pores in the expandable bubble portion wall 171 and pores in the diaphonic valve diaphragm membrane wall 147 may function to both relieve excess pressure and enhance audio transmission. These pores 171 allow for relief of back pressure which otherwise might cause full seating and thus full closure of the porting and valve assemblies, which would then result in interruptions or fluctuations in the audio signal. Another embodiment eliminates the membrane monoports 143 and 146 and instead relies solely on pores in the diaphonic membranes 147 to achieve the functions of pumping, acoustical transmission, and relief of excess pressure. This embodiment relies on the opening and closing of the pores 147 as the membranes 142 and 145 flex during operation and thus does not require the use of valve seats 133 and 152, using adjustable restricting screens instead. These adjustable screens allow the valve to operate both inflation and deflation modes according to their lateral positioning.

Figure 24:
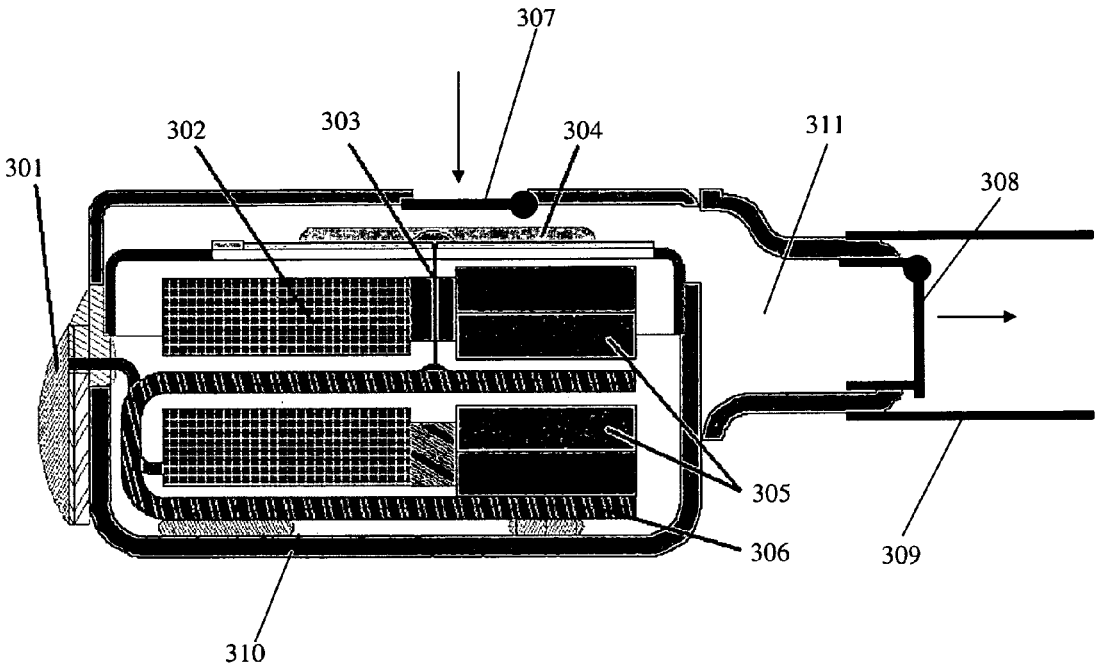
FIG. 24 shows an embodiment of a hearing aid/pump assembly which may be used with embodiments of the disclosed acoustic device.

In an embodiment, referring to FIG. 1, the device may be designed to coupled with a broad range of existing, commercial, personal-listening-device ear buds or other similar devices (See e.g. FIGS. 9A-B). Other embodiments include devices in which the diaphonic valve assembly's 101 pumping and audio transmission functions are built directly into the audio transducer housing either on the front of the transducer 111 or at its rear. Small hearing aid transducers can also be fitted with similar valve or pumping apparatuses which harvest and produce inflation pressures from suitable electronic signals. These embodiments range from stand-alone valve configurations which can be affixed to extant transducers or custom transducers whose design includes the valve apparatus integral to the device. FIG. 24 shows an example of such a pump assembly which may be used with hearing aid embodiments of acoustic device 101. AC voltage applied to input terminals 301, causes current to flow in coil 302, surrounding armature structure 306, resulting in an alternating change in magnetic polarity. Change in polarity causes upper portion of armature 306 to move up and down due to alternate attraction to upper and lower magnets 305, which in turn move drive pin 303 and connected diaphragm 304 up and down in trapped volume 311 of sealed enclosure 310.

Downward motion of diaphragm 304 reduces pressure in trapped volume 311, causing inlet valve 307 to open drawing air into volume 311. Upward motion of diaphragm 304 causes pressure in trapped air volume 311 to increase forcing outlet valve 308 to open and air to flow into inflation/deflation tube 309. By reversing locations of inlet and outlet valves 307, 308 air is drawn from the inflation/deflation tube 309. In another embodiment, each of these valves 307, 308 could be replaced by a dual-purpose valve that could be electronically switched between ingress and egress functions. One process for achieving this duality is through the use of valves created using microelectromechanical systems (MEMS) techniques.

In some embodiments, the assembly may be rear mounted wherein pressure is harvested from the rear of the audio transducer 110 and channeled though a low-pass frequency pressure baffle and pressure delivery tube (not shown) to the expandable bubble portion 170, via the sound and pressure delivery tube 160. In this embodiment, preferably only inflation pressures rather than audio vibrations are passed through the low-pass baffle to the expandable bubble portion 170 by the diaphonic assembly 103.

Now referring to FIGS. 10-14, additional embodiments of the device 101 may separate the pumping and audio transmission functionalities, and do not use pressure from the audio transducer 110 to pressurize or inflate the expandable bubble portion 170. Rather, as shown in FIGS. 10-14, the expandable bubble portion 170 may be inflated by pressure generated separately from another means for inflating the expandable bubble portion 170 such as without limitation, an electronic pump or a mechanical pump (e.g. bellows, syringe, etc). For instance, the pressure with which to pressurize and inflate the expandable bubble portion 170 may be supplied by a pump 265 which may be coupled to a pressurizing audio connection cord adapter 267 such as the hollow TRS (Tip Ring, Sleeve) plugs shown in FIG. 13-14. Connection adapter 267 preferably is compatible with existing female connections used in audio devices and/or personal headsets. The purpose of the connection adapter 267 is to provide a conduit by which the pump 265 can pump air into the expandable bubble portion 170. Furthermore, the connection adapter 267 may provide an electrical connection between the media device 269 and the acoustic transduction device 101.

Figure 11:
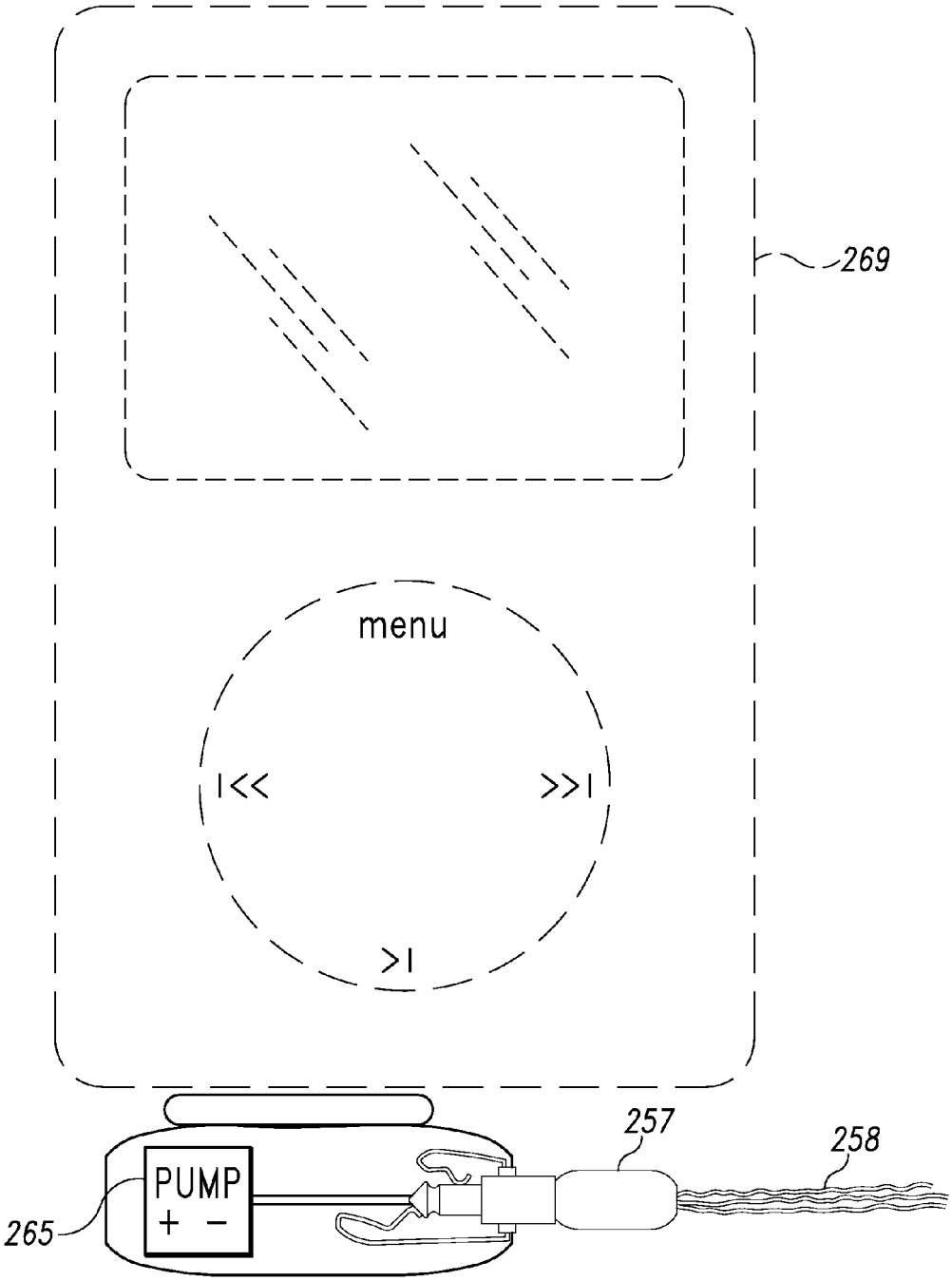
FIG. 11 shows a media player, a pump a hollow tip, ring and sleeve (TRS) plug and a chassis mounted female audio jack.
Figure 12:
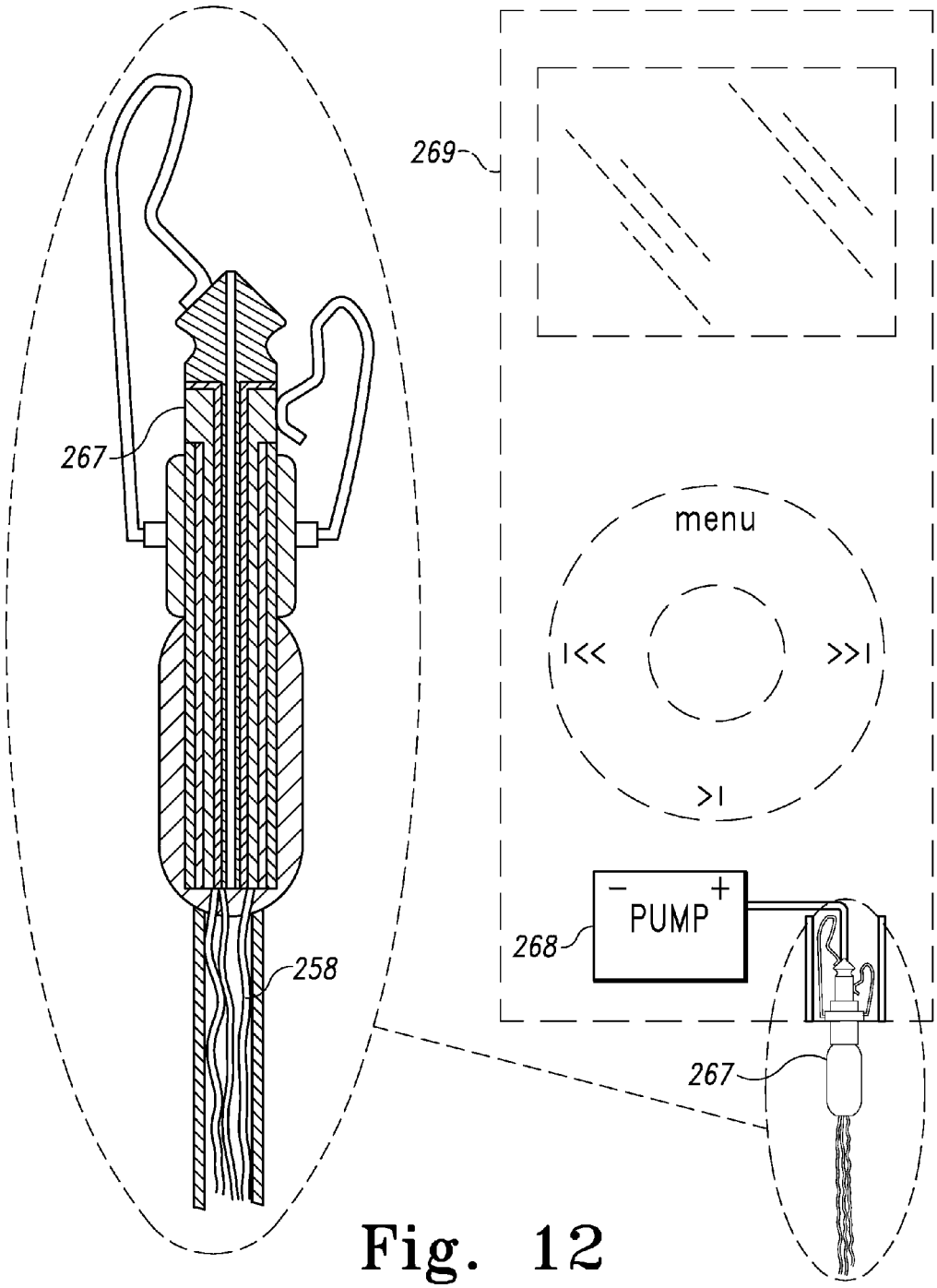
FIG. 12 shows a media player, a hollow tip, ring and sleeve (TRS) plug, a female audio jack, and a pump and a pressure transmitting tube and O-ring pump assembly integrated within the media player.
Figure 13:
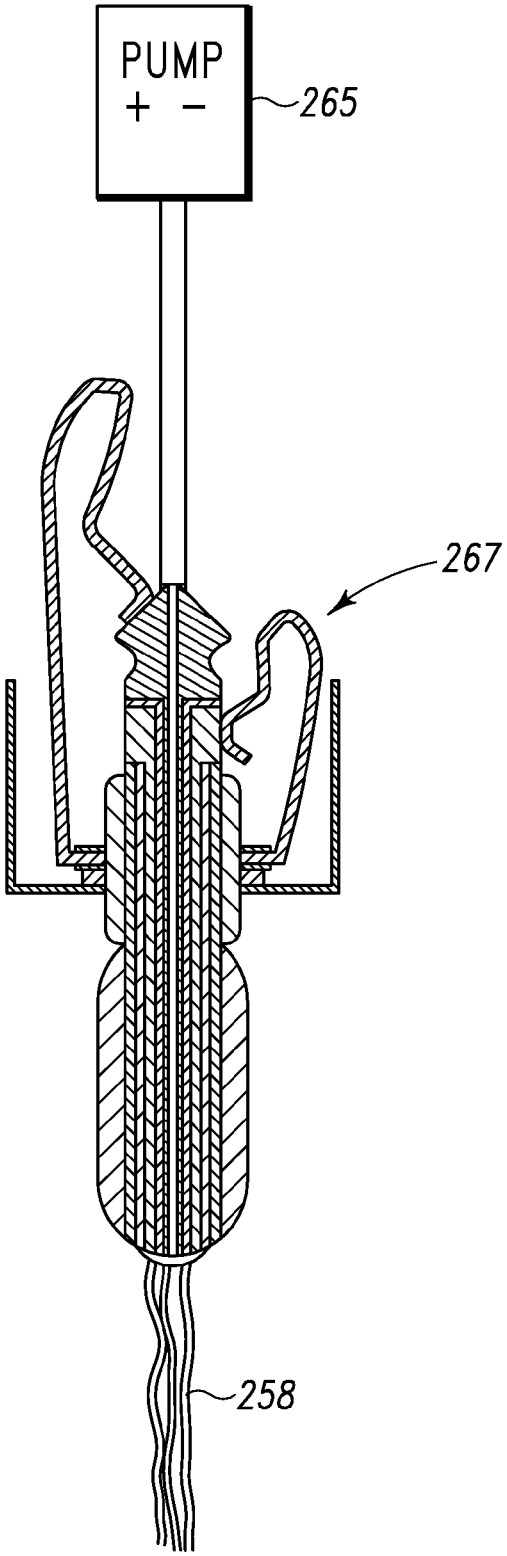
FIG. 13 illustrates a close-up of a chassis mounted pressure transmitting TRS plug and jack, (vertical) with a pump and a pressure transmitting tube and o-ring assembly.
Figure 14:
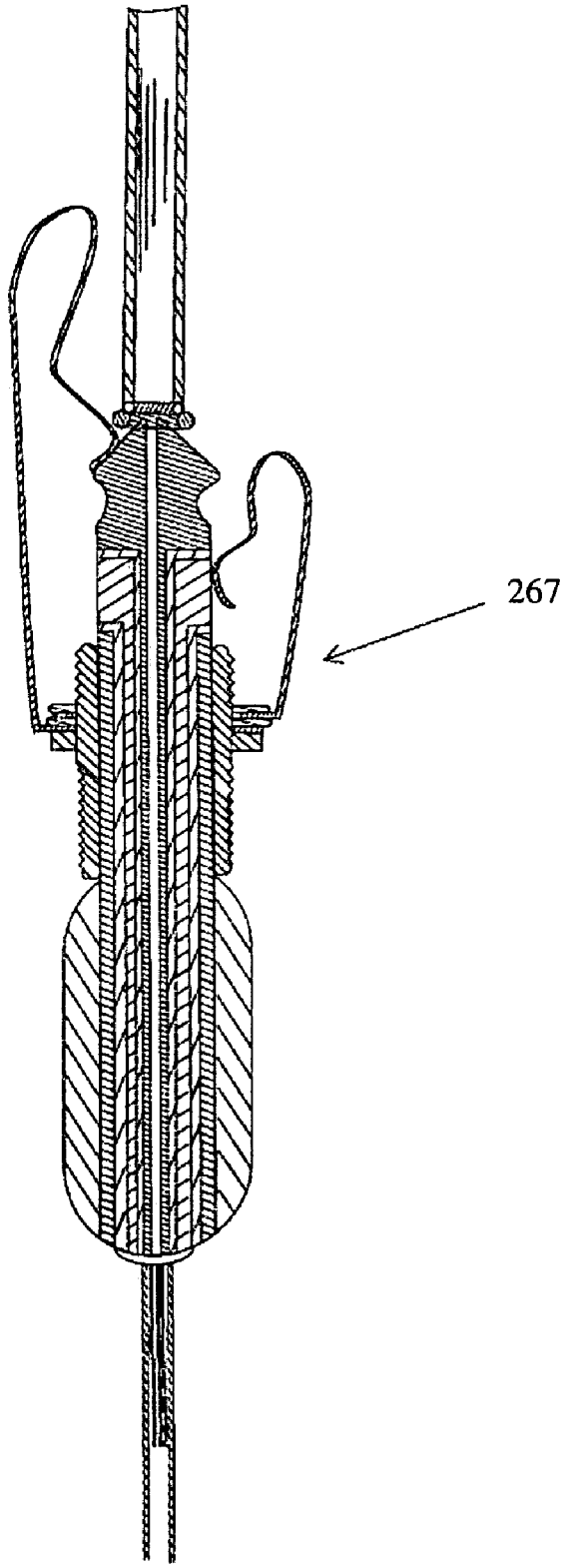
FIG. 14 is a close-up drawing of a hollow pressure transmitting TRS plug and jack and a pressure transmitting tube and o-ring assembly for use with an external pump.

As shown in FIG. 11, the pump 265 may be attached and in communication with a media playing device body 269, thereby creating a pressurizing communication between the expandable bubble portion 170 and/or media playing device, or on the pressurizing electrical connection cord 258 between the embodiments of the disclosed device 111 and a personal listening device headset containing audio transducer(s) 110, or in some other location. Other embodiments may incorporate the use of a small manual bellows pump or manual syringe pump together with a check valve and pressure regulator control, and may or may not be stored in an external pressure reservoir. Pressure with which to pressurize and inflate the expandable bubble portion 170 in or on the ear would be transmitted via a remote pressurization tube containing audio transducer wiring which could run from any pressure generation source 265 to a personal listening device headset containing audio transducer(s) 110. In an embodiment shown in FIG. 12, the pressure generation source 265 is contained in the body of the communication and/or media playing device, thereby creating a pressurizing communication and/or media playing device 269, or within the pressurizing electrical connection cord 258. A tube transmitting the pressure could run alone, beside or within the same housing as the cord electrically connecting audio device 269 to a personal listening device headset. In an embodiment, a hollow audio connection plug 267 passes inflation and pressurization pressures in addition to making electrical contact between audio transducer 110 and said audio device 269.

One of the many novel features of the device is that the expandable acoustically resonant bubble portion 170 may be controllable by the user during operation for optimum on-ear or in-ear audio transmission and coupling to the tympanic membrane.

In another embodiment, the diaphonic assembly 103 may be a means by which pressure for membrane inflation, pressurization and user control may be easily generated when retrofitting existing listening devices which have been already sold or manufactured. Additionally, it may offer significant utility by allowing for the design and manufacture of embodiments which rely only upon audio transducer(s) 110 for inflation, pressurization and control purposes, thereby reducing the cost of both materials and manufacturing. Inflation-pressure generating waveform allows for a means of energizing and controlling said diaphonic assembly without the use of an external pressure generation source 266, and may be provided by the inclusion of an electronic waveform generator (not shown) in the electrical connection cord, cord adaptor or audio device 269, or prerecorded over the audio media content being listened to.

Additional features of the device include remote inflation, pressurization and control methods involving the use of said manual bellows pump or manual syringe pump, an external pressure reservoir, said pressurizing communication and/or media playing device 269, said pressurizing audio connection plug 267, said pressure transmitting hollow audio connection cord 258 containing audio transducer or other wiring for single or multiple audio transducers, be they speakers or microphones.

Regardless of the type of device (valve assembly 103 and the like, external manual pump, or external mechanical pump or fan) and placement of embodiments of the device (in front of the ear bud transducer as in FIG. 1, behind the ear bud transducer as in FIG. 2 or externally) used to inflate and control expandable bubble portion pressure, various embodiments may contain a function to control impedance matching, acoustic properties of the inflatable membrane, ear canal air refresh rate and air cushion, acoustic seal to the ear, user comfort and fit, back pressure on the acoustical elements such as the diaphragm 111, and other aforementioned parameters and characteristics.

As described, the expandable bubble portion may be both inflated and deflated by user control during operation. This control is useful not only for the insertion or removal of the device from the ear, but also allows fine adjustment of the inflatable membrane pressure thereby providing a means for precise adjustment of dual impedance matching, acoustic properties, ear canal air refresh rate and air cushioning, acoustic seal to the tympanic membrane, user comfort and fit, back pressure, equalization with ambient air pressures, temperatures and admittance or isolation of ambient sounds. The user control of adequate perception or occlusion of environmental sound is especially important to the safe operation of all personal listening devices and is not generally provided for in existing devices. Additionally, deflation provides an important method for withdrawing the expandable bubble portion and sound and pressure delivery tube 160 back into a protective enclosure when not in use. This enclosure may be a protective sheath or housing surrounding the pressure delivery tube 160.

Deflation or depressurization in the self-inflating embodiment of FIG. 1, is affected by the user by adjusting the inflation-pressure generating waveform or turning it off, thereby decreasing the operation of the pumping mechanism of 103. When the pumping is reduced, air pressure released from the pores 171 in the expandable bubble portion wall allows air to escape faster than it is replenished and the membrane deflates. Additionally, the adjustable pressure release valve 162 allows the user to manually relieve pressure and deflate the resonant membrane, thereby adjusting impedance matching and other aforementioned interactive operation parameters. In embodiments where the expandable bubble portion is inflated via internal or external manual or electrical/mechanical pumps or fans the expandable bubble portion can also be deflated and withdrawn by reversing the operation of these external pressure generating devices. In expandable pleated or folded embodiments comprised from non-extensible, non-elastic materials, utilization of material memory of the deflated folded form allows for proper loading or impedance matching of an audio transducer and also precludes the need for deflation vacuum pumping actions. As with extensible or elastic membranes such as balloons, the device is deflated by simply lowering the positive inflation pump pressure.

As described above, in an alternative embodiment, the diaphonic valve and pumping mechanism 206 (as shown in FIG. 2) may be placed at the rear of the audio transducer 111. Unlike the previous embodiment, shown in FIG. 1, which allows for retrofitting the millions of ear bud type audio devices already sold to consumers, this embodiment may call for incorporation of the disclosed devices into the design and construction of a new ear bud product. Its advantages include a direct acoustic transmission from the front side of audio transducer 111 to the expandable bubble portion 170, which bypasses any interposition of the diaphonic valve apparatus. Pressure with which to inflate and control said expandable bubble portion 170 is generated by means of a rear mounted diaphonic valve assembly 206, which is similar to that shown in FIG. 1, and which is driven in a similar manner to the previously stated embodiment shown in FIG. 1, but by pressures which occur on the reverse side of audio diaphragm 111.

Since only inflation pressure and not acoustic content is required from the rear mounted diaphonic valve 206 (the acoustic content being conventionally transmitted from the front of audio transducer 111 into the expandable bubble portion 170) the diaphonic aspect of this valve 206 only refers to its ability to transduce audio sound waves into inflation pressures, and not necessarily to any refraction or transmission of audio content into the expandable bubble portion 170. On the contrary, the design and construction of the rear mounted diaphonic valve assembly 206 comprises a means for damping acoustic content which otherwise would cause unwanted frequency cancellations/reinforcements with the audio content generated by the front of diaphragm 111. This is accomplished through the addition of an acoustic low-pass filter baffle (not shown) into the pressure delivery tube 160, which connects said rear mounted diaphonic valve assembly 206 to the expandable bubble portion 170 via the sound and pressures delivery tube. Otherwise, the operation and construction of this device is consistent with the previous embodiment 103 shown in FIG. 1.

Another embodiment incorporates the use of an additional transducer (not shown) or a plurality of same, electronically wired in series or parallel with audio transducer 110, which is dedicated to inflation purposes only, or primarily. Where the transducer is used only for inflation and wired in series (in same circuit), the diaphonic valve is again only diaphonic in the sense that it transduces sound waves into inflation pressures. In this arrangement acoustic filters such as a low-pass frequency pressure baffle may be only necessary to the degree that the physical placement of or pressure generated by the additional transducer(s) results in acoustic frequency cancellations or reinforcements which degrade audio content. Wired separately this inflation transducer can be manipulated directly at optimum frequency waveforms by a dedicated electronic circuit, without regard to audio content degradations. In embodiments wherein the additional transducer is used for both inflation and audio purposes such as bass reinforcement, construction and design must consider acoustic phase cancellation and reinforcement in the placement, baffling and channeling methods utilized. The incorporation of an electronic crossover also may be desirable in embodiments having two or more transducers per ear.

Any mechanism which pressurizes and controls the various aforementioned and other parameters of said diaphonic expandable bubble portion 170 without the use of a valve, diaphonic or otherwise, may be used in conjunction with embodiments of the device including but not limited to pre-pressurized reservoirs, fans, chemical pressure generators, or valveless pumps of any kind, whether remote to or incorporated in said audio transducers.

A user adjustable input valve or pressure regulator may be disposed between the pressure generation source 265 and the diaphonic expandable bubble portion 170 in embodiments wherein pressure generation pressures are not electronically or otherwise controlled.

III. Further Applications of Embodiments of the Diaphonic Acoustic Device

As sound vibrations travel through the conductive media of air between the audio transducer 111 and said diaphonic assembly or the conductive media of air and the inflated or pressurized bubble portion 170, they are refracted by being conducted through a moving or vibrating lens comprised of the polymeric material described above. In addition to refracting or bending the sound waves to a plane which is perpendicular to the membrane surface, the elastic polymeric membrane constituents a mobile lens. Unlike a stationary lens, (such as a prism, as in light waves) a moving or vibrating sound lens results in both negative and positive refractions (convex and concave) wherein sound waves are dispersed more effectively in a radiating pattern. The dispersion afforded by the moving sound lenses results in a greater discernability of audio content in in-ear and on-ear audio applications. The dispersion may also allow for electronic mixing of amplified environmental sounds, vocals, special effects (i.e. in computer or video games), personal studio, noise cancellation, karaoke, electronic stethoscopes, etc.

Because of the aforementioned variable acoustic seal and noise canceling isolation methods described, embodiments of the device afford the binaural placement of mono or stereo microphones on the audio transducer 110 or in other supra-aural locations. This affords the electronic mixing of environmental sounds which are audio imaged to the listener in the locations in which they occur environmentally. This not only affords a safer environmental interaction for the user when surprised by ambulance sirens or stimulus requiring immediate response, it allows the user to utilize conventional digital signal processing devices to add reverb, echo, equalization, compression and other recording studio effects to his listening experience, and to use the device as a professional stage monitor or personal karaoke apparatus.

In particular embodiments, an intra-ear user interface may be incorporated wherein user originated teeth clicks, guttural sounds, or any computer recognizable non verbal communication may be sensed by the sound's resonance in the ear canal and used as an audio user interface to control electronic or mechanical devices with commands which are private to the user. Additionally, and because of the same sensing of this in-ear resonance, embodiments of the device may be capable of providing a computer with a positive identification of which verbal or nonverbal commands it should follow or ignore, there being more that one person speaking.

A. Audio Conduction Through Cephalic Tissue Via the Ear Canal

The transduction properties of cephalic tissue (e.g. skin, skull, cerebral fluid, etc.) make it especially sensitive to vibrations made by direct contact with the vibrations resident in acoustically resonating chambers or members. This is in contrast to the surrounding auricle or flesh or any other externally exposed part of the human anatomy. Audio vibrations which are also transduced directly into the ear canal wall are sensed by the cochlea at greater volume levels than audio vibrations which create perceivable acoustic sound pressure levels but which are not in contact with the skin comprising ear canal wall. This acoustic transduction is referred to as tissue conduction, a technical term which is used to describe all sound which is sensed by the cochlea via the vibrations which resonate through the bones, flesh, organs or fluids of the body. Second only to the tympanic membrane, the ear canal wall is extremely conductive of external sound transductions.

The bubble portion 170 not only transmits sound waves to the tympanic membrane through the air contained within the ear canal, it also transduces these vibrations directly into the skin and flesh comprising the ear canal wall. This stimulates the cochlea through a portion of the alternate transduction paths which are traveled by the acoustic vibrations which enter the head through the eyes, nose, pharynx, sinus cavities, flesh covering of the face and head, etc. when the listener experiences external sound sources, including live concerts. Therefore, listening experiences provided by the use of an expandable bubble portion 170 result in a heightened and enhanced fidelity which more closely approximates the acoustic effects of natural external sounds, not realized in conventional personal listening devices.

Furthermore, a multi-chambered expandable bubble portion 170 embodiment vibrated by respective multiple transducers can be used to stimulate various different bone conduction paths to the cochlea. A variety of potential physical placements of these chambers in quadrants results in various potential combinations of sounds transduced along distinctly different cochlear paths which may provide a virtual three-dimensional listening experience not available in current audio devices.

Due to the tremendous acoustic transduction efficiency of an audio transducer impedance-matched and coupled to the flesh via an expandable bubble portion 170, bone conduction methods may be utilized for private communications, video games or hearing impaired listeners wherein acoustic transduction paths to the cochlea are stimulated by direct contract with ordinarily non-ear-related body parts. For instance, an expandable bubble portion 170 lodged or surgically implanted in the mouth or cheek effectively transduces sound to the cochlea. In cases involving diseased or damaged ear anatomy, resonant members may be gently inflated in direct contact with a tympanic membrane or parts of the inner ear to effectively transduce sound to the cochlea. Artificial teeth may be fitted with expandable bubble portions 170 for purposes of the direct transduction of sound. Surgical implants of the acoustic device 101 may offer these benefits in a permanent and more portable embodiment, especially for, but not limited to, the hearing impaired. Furthermore, medical implantation of embodiments of acoustic device 101 may be used in applications where constant radio input may be required such as in military personnel.

B. Noise Cancellation

Embodiments of the device may be used in noise cancellation applications. The alternate transduction paths which are traveled by the acoustic vibrations which enter the head through the eyes, nose, pharynx, sinus cavities, flesh covering of the face and head, etc. when the listener experiences external sound sources can be effectively damped by the transduction of these same vibrations emanating from the expandable bubble portion 170 directly out of phase and at the appropriate volume levels and audio frequencies necessary to noise cancellation. This affords effective hearing protection and isolation schemes which were never before possible. While ear plugs or muffs can dampen excessive noise pollution traveling down the ear canal, OSHA still warns of hearing damage which occurs through alternate transduction paths to the cochlea. Short of heavy enclosed helmets, no portable technology has existed which mitigates these dangers. Through noise cancellation via transduction schemes, embodiments of the acoustic device may offer many unique and vital sound isolation and noise protection applications.

C. Methods of Preventing Cerumen or Ear Wax Buildup

In another embodiment, the disclosed acoustic device may be used to prevent ear wax build-up. Inflated resonant bubble portions effectively protect speakers and listening device components from cerumen by containing them within a disposable or changeable enclosing membrane. Breathable membranes or donuts pressurized by a slight active flow of air create a positive pressure environment which protects the device components from external contamination and also refreshes the air contained in the ear canal, constantly venting it to the outside ambient air. Cerumen laden vapor is not allowed to accumulate, and in-ear temperatures are effectively lowered. A donut embodiment can have a pressurized acoustic path through its center and sufficient wrinkles or ridges along membrane surface to allow for the continual and gentle expulsion of in-ear vapors.

To further illustrate different aspects and features of the invention, the following example is provided:

EXAMPLE

Testing Method Utilized

In human anatomy, the auditory meatus or ear canal roughly averages a length ⅙th of the width of the head, as measured between the ears. In adults, this translates into approximately 18 to 30 mm for each canal, and places the middle ear behind the eyes which, together with the nose, mouth, sinus and other cavities, conduct sound waves into the acoustic chamber it contains. For purposes of these tests, an artificial canal of 25 mm was constructed from a length of compliant polymer tubing with an internal diameter of 8 mm. One end of the artificial canal provided means for the placement and acoustical sealing of a Crown® CM-311A microphone capsule, while the other provided an artificial auricle or outer ear cup for purposes of supporting or acoustically sealing the ear bud housing. This artificial canal was used in test measurements where the goal was to evaluate acoustical performance of a device (ear bud transducer or the expandable bubble portion 170) as it would be experienced by a listener's tympanic membrane. For comparison, other measurements were done in open air. The CM-311A microphone capsule when placed on the end of the artificial ear canal is a reasonably good approximation to the eardrum, both in the pressure characteristics and pressure adjustability of the chamber behind its membrane, which is a good approximation of the characteristics of the middle ear. All tests were conducted using ear buds provided with an Apple® iPod Nano, manufacturer's packaging part #603-7455.

A computer based signal generator was used to produce the range of frequencies for the tests. These frequencies were converted into sound via a digital to analog converter (DAC) and transmitted to the ear bud transducer generating the primary sound for the tests.

Test Results

Figure 15A:
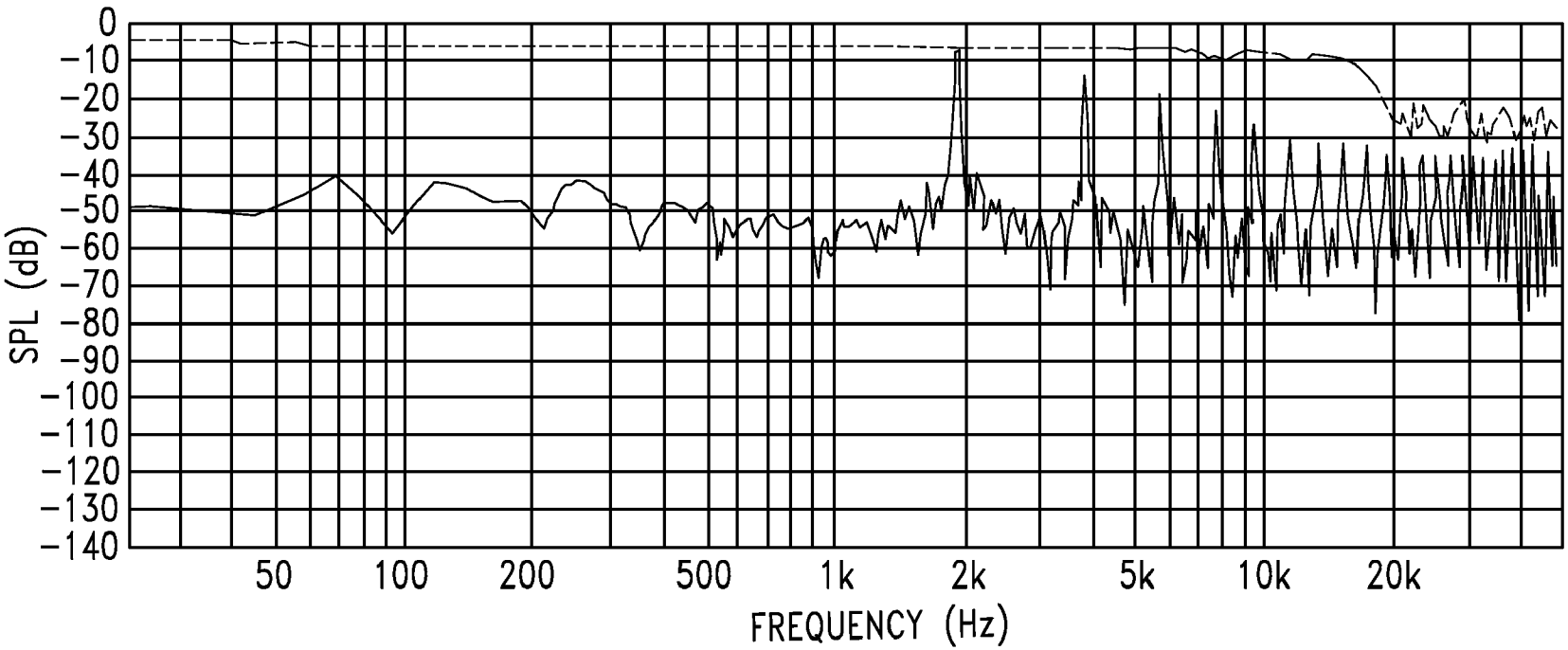
FIG. 15 is a plot of the fundamental and harmonic content of 20 Hz to 20 kHz audio sine wave frequency sweep emissions transmitted to an audio transducer pre-digital to analog conversion (DAC)
Figure 15B:
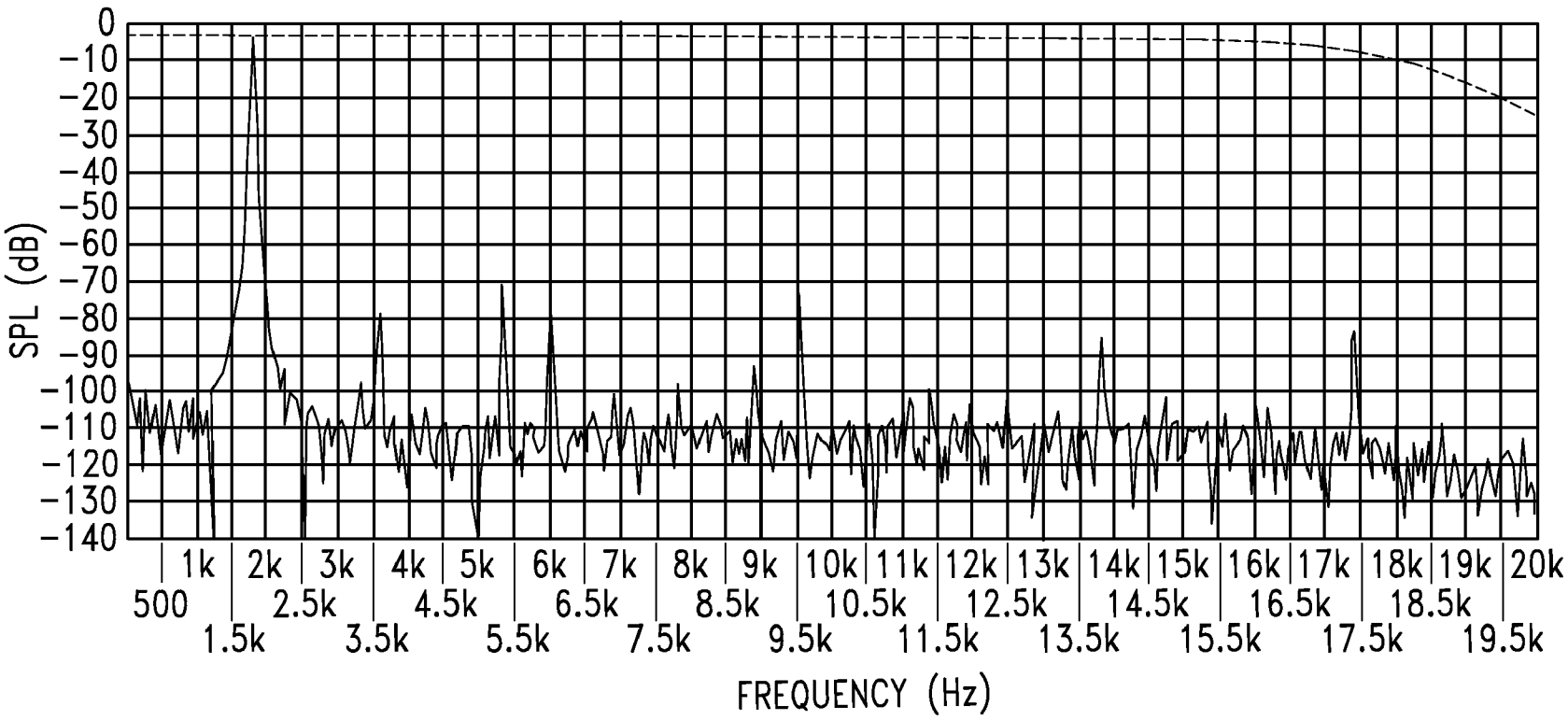

FIG. 15 shows the fundamental and harmonic content of the 20 Hz to 20 kHz audio sine wave frequency sweep as generated by the computer software, prior to transmission to the DAC. The upper graph shows this spectrum on a log scale, on which the harmonic content is more visible. The lower graph shows the same spectrum on a linear scale, in which the actual signal to noise ratio is more evident and the noise floor is shown at around −100 dB or better. In each of these two graphs the lower, grey curve is the actual wave form, and the upper black curve is the envelope of peak frequency amplitudes.

Figure 16:
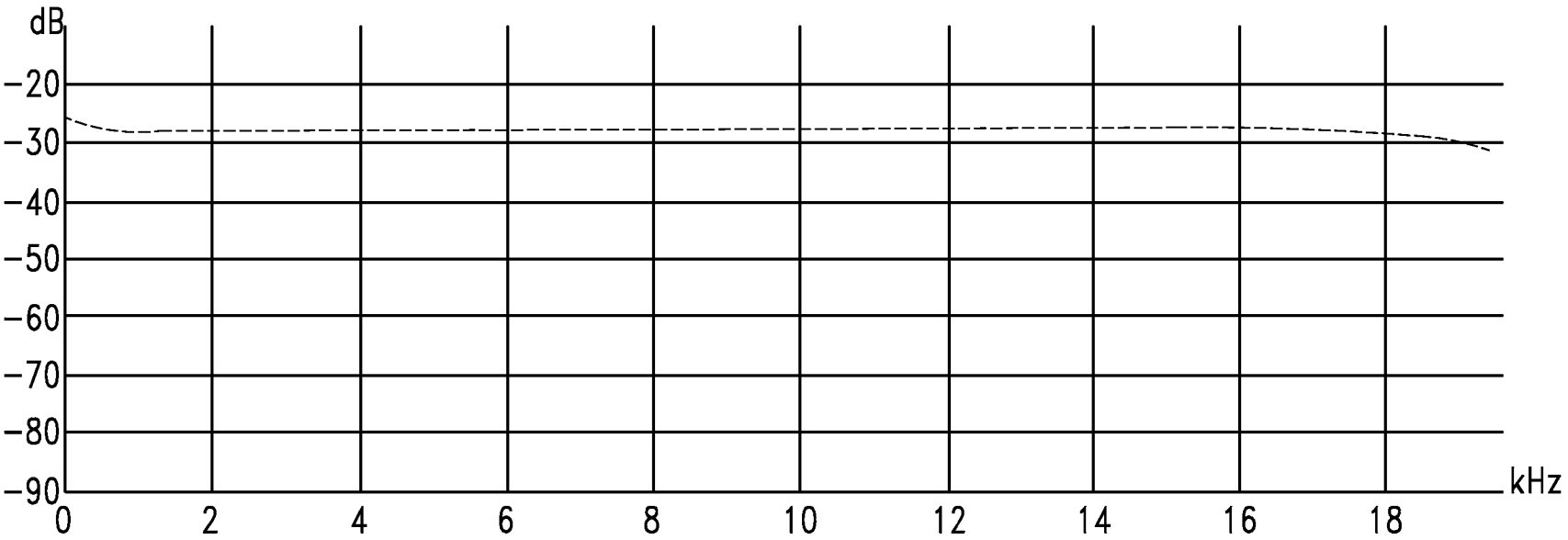
FIG. 16 is a plot of 20 Hz to 20 kHz audio sine wave frequency sweep signal emissions measured at the iPod® audio transducer input.

FIG. 16 shows the 20 Hz to 20 kHz envelope of peak frequency amplitudes, analogous to the upper black curves in FIG. 35, after passing through the DAC, as they are found at the iPod® audio transducer input. The driving signal used for testing is therefore very uniform over the full frequency range.

Figure 17:
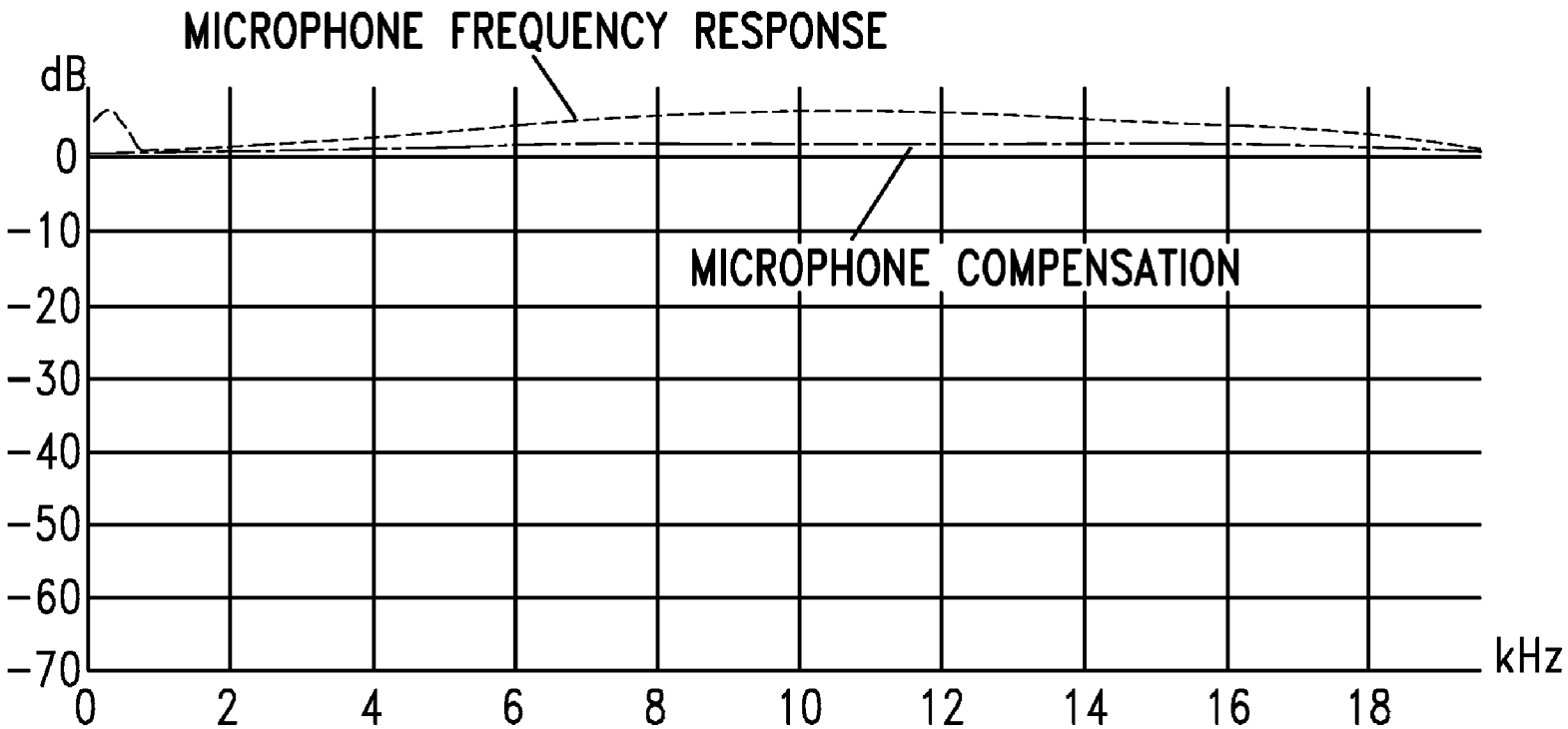
FIG. 17 is a plot of the Crown CM-311A Differoid® Condenser Microphone manufacturer's frequency response.

The unbroken line in FIG. 17 shows a linear graph of the manufacturer's frequency response graph for the Crown® CM-311A condenser microphone used in this testing. The dashed line represents the response after the application of the microphone sensitivity compensation formula. This compensation formula was also applied to all subsequent audio spectra recorded with this microphone.

Figure 18:
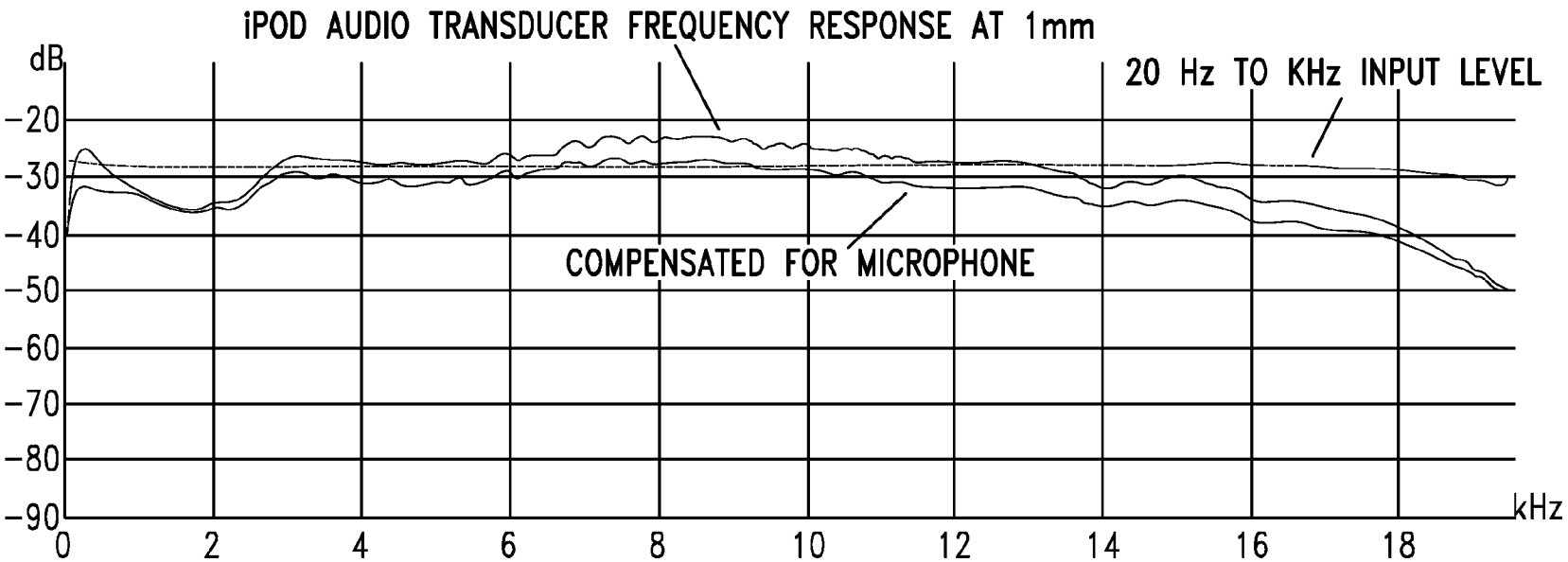
FIG. 18 is a plot of 20 Hz to 20 kHz audio sine wave frequency sweep signal emissions from the iPod® audio transducer mounted 1 mm axially proximal to the Crown CM-311A Differoid® Microphone Capsule as preamplified by the SPS-66 DAC.

FIG. 18 shows the frequency response detected by the Crown® CM-311A when placed in the open air at a distance of 1 mm from the iPod® audio transducer as the transducer is driven through the 20 Hz to 20 kHz audio sine wave frequency sweep as represented by the large-dashed line. The upper solid curve represents the raw signal detected by the microphone and the lower dashed curve represents that signal after application of the microphone sensitivity compensation formula. Only sweeps which have been compensated for microphone sensitivity are presented.

Figure 19:
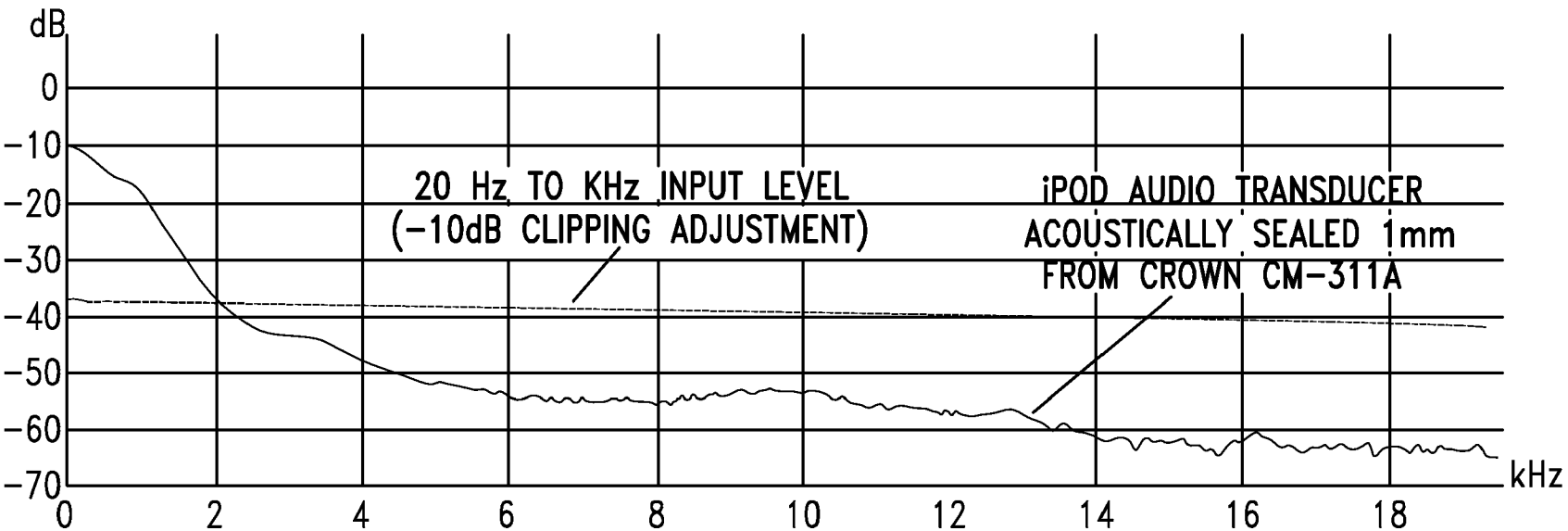
FIG. 19 is a plot of 20 Hz to 20 kHz audio sine wave frequency sweep signal emissions from the iPod® audio transducer acoustically sealed 1 mm axially proximal to the Crown CM-311A Microphone as preamplified by SPS-66 DAC.

FIG. 19 shows the measurement of the 20 Hz to 20 kHz audio sine wave frequency sweep signal emissions from the iPod® audio transducer when coupled to the Crown® CM-311A by an acoustically sealed 1 mm long tube. Sealing the driving transducer and the microphone together with a tube had the effect of producing a bass dominated response which overwhelmed the higher frequencies in the spectrum. The large-dashed line shows the 20 Hz to 20 kHz input level amplitude attenuated −10 dB from that used in FIG. 18 in order to prevent the increase in bass response from saturating (clipping) the microphone preamplifier. Ideally, a good in-ear device should produce the flattest possible frequency response over the greatest possible frequency range with this flatness being most important in the music and communication frequency range, i.e. the voice range which typically ranges from 300 Hz to 3.4 kHz. The flatness of the response is more important than the overall dB level which can then be raised without clipping because the bass is no longer dominant.

Figure 20:
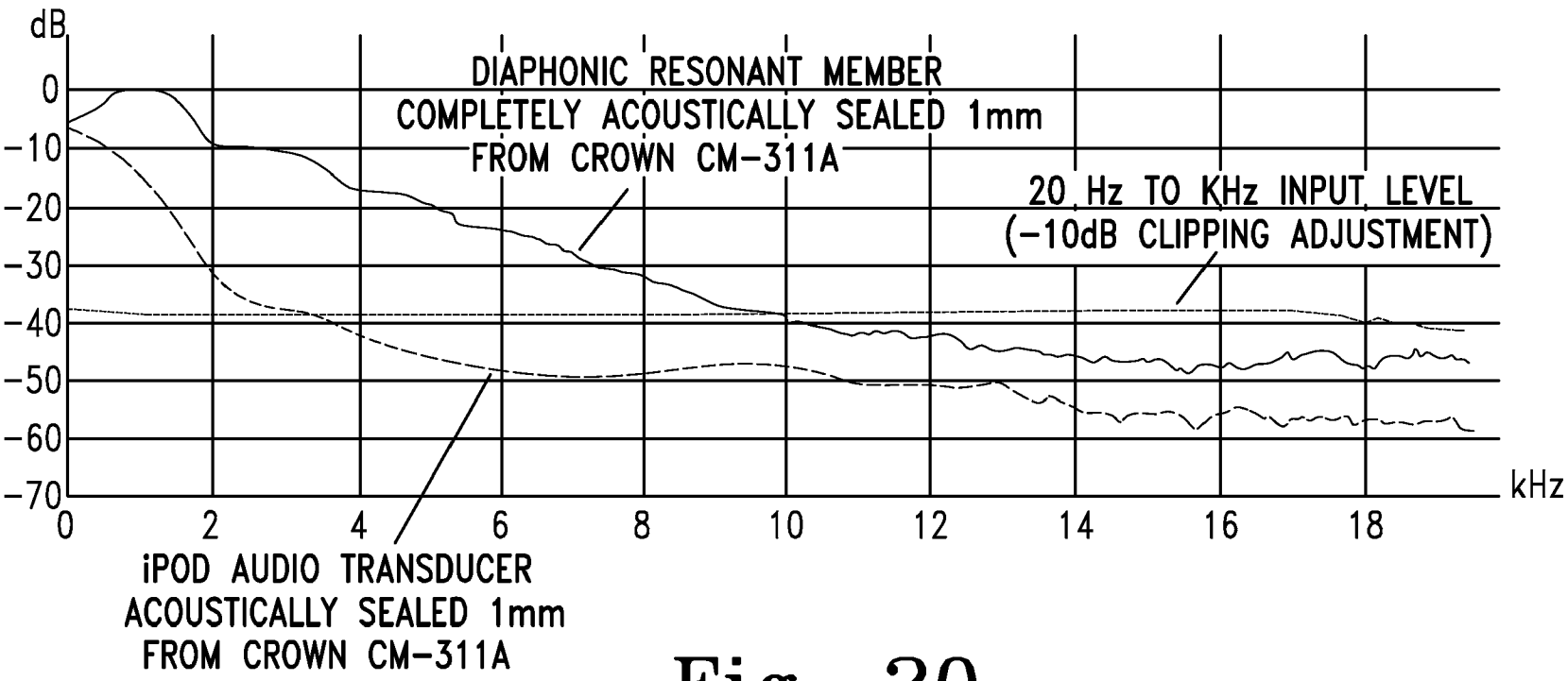
FIG. 20 is a plot of 20 Hz to 20 kHz audio sine wave frequency sweep signal emissions from the iPod® audio transducer mounted with the diaphonic resonant membrane acoustically sealed 1 mm axially proximate to the Crown CM-311A Microphone Differoid® Capsule within a 13 mm tube as preamplified by SPS-66.

The solid line in FIG. 20 shows the measurement of 20 Hz to 20 kHz audio sine wave frequency sweep signal emissions from the iPod® audio transducer mounted with a diaphonic resonant membrane. The bubble portion 170 was sealed in a 13 mm long tube at the other end of which was sealed the Crown® CM-311A microphone. The end of the inflated bubble was located 1 mm from the microphone, thus providing a comparison to the conditions of the test in FIG. 19. By contrast to the results in FIG. 19, the presence of the diaphonic membrane bubble results in greatly improved midrange and high response. The small-dashed line shows the curve from FIG. 19 for comparison. The large-dashed line shows the 20 Hz to 20 kHz input level amplitude attenuated −10 dB to allow for the microphone preamplifier clipping produced by the acoustic seal. This test indicated an improvement, i.e. a flattening of the response curve using the diaphonic resonant bubble. A further feature of embodiments of the device is the ability to impedance match the bubble response to the ear canal by adjusting internal pressure in the bubble as is done in the tests represented in FIG. 21.

Figure 21:
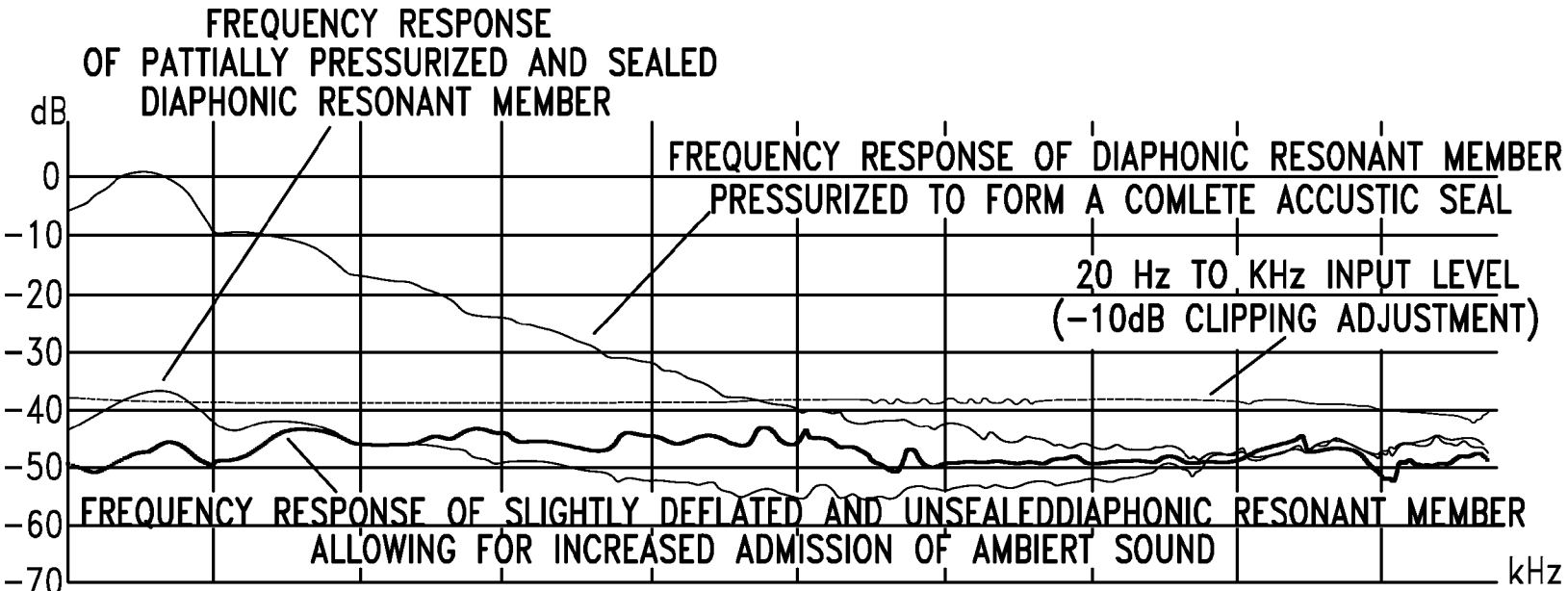
FIG. 21 is a plot of three separate measurements of 20 Hz to 20 kHz audio sine wave frequency sweep signal emissions from the iPod® audio transducer mounted with a diaphonic resonant membrane variably pressurized and acoustically sealed 1 mm axially proximate to the Crown CM-311A Differoid® Microphone Capsule within a 13 mm tube as preamplified by SPS-66.

FIG. 21 shows three separate measurements of the 20 Hz to 20 kHz audio sine wave frequency sweep emissions from the iPod® audio transducer mounted with the diaphonic resonant membrane within a 13 mm tube with the other end sealed 1 mm from the Crown CM-311A microphone. In this case, variable pressures within the diaphonic membrane bubble resulted in different degrees of impedance matching to both the iPod® audio transducer and to the microphone. The solid line curve, which is the same as the solid line curve in FIG. 40, shows an initial high membrane pressure result. The large-dashed line shows the 20 Hz to 20 kHz input level amplitude attenuated −10 dB to allow for the microphone preamplifier clipping produced by the acoustic seal. The two dashed line curves show the response for two different lower pressure levels which better impedance match the system and produce much flatter responses over the entire frequency range. Such responses are ideal for an in-ear acoustical device, and with increased input volumes, allow for greater overall volume, experienced by the listener, without distortion or heavy bass dominance.

Figure 22:
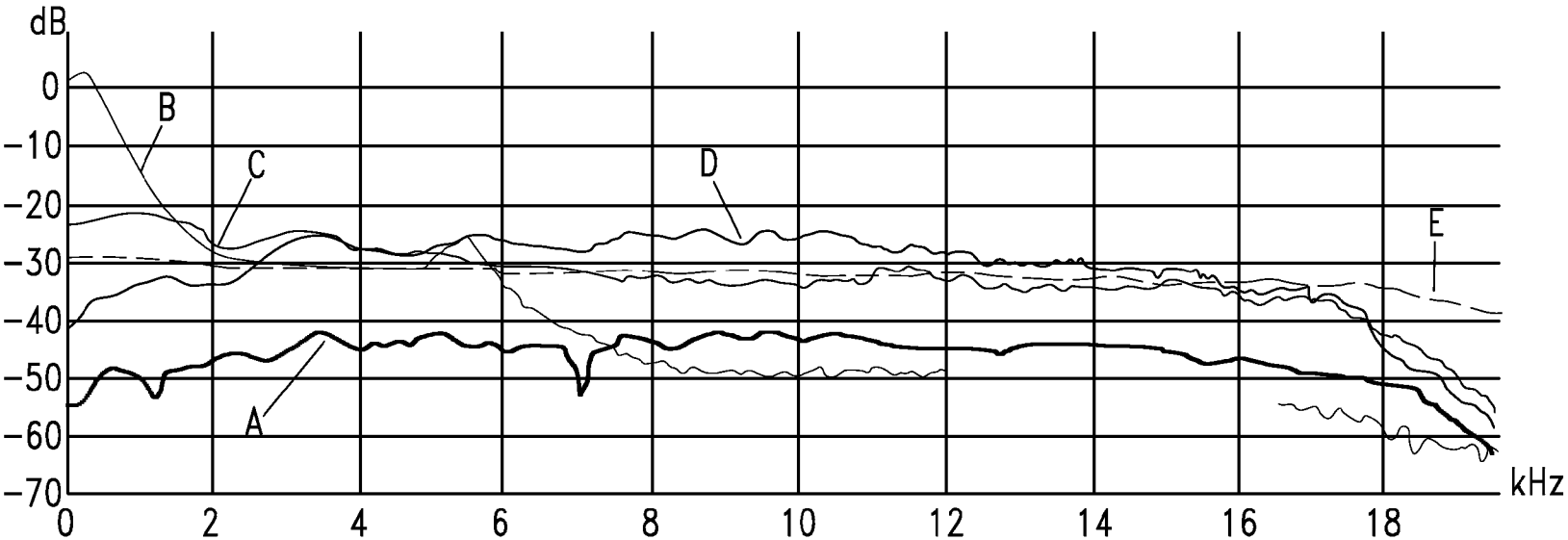
FIG. 22 is a plot of four measurements of the 20 Hz to 20 kHz audio sine wave frequency sweep signal emissions from the iPod® audio transducer with and without the expandable bubble portion 170. Curve (A): open air (no tube) iPod® audio transducer 25 mm axially proximal and the Crown CM-311A. Curve (B): acoustically sealed iPod® audio transducer 25 mm axially proximal and the Crown CM-311A. Curves (C) and (D): acoustically sealed bubble portion mounted to the iPod® audio transducer 25 mm axially proximal and the Crown CM-311A, variably pressurized. These two curves represent two different bubble portion pressure levels and thus two different impedance matching conditions. Graph line (E) represents the 20 Hz to 20 kHz audio sine wave frequency sweep signal emissions measured at the iPod® audio transducer input.
Figure 23:
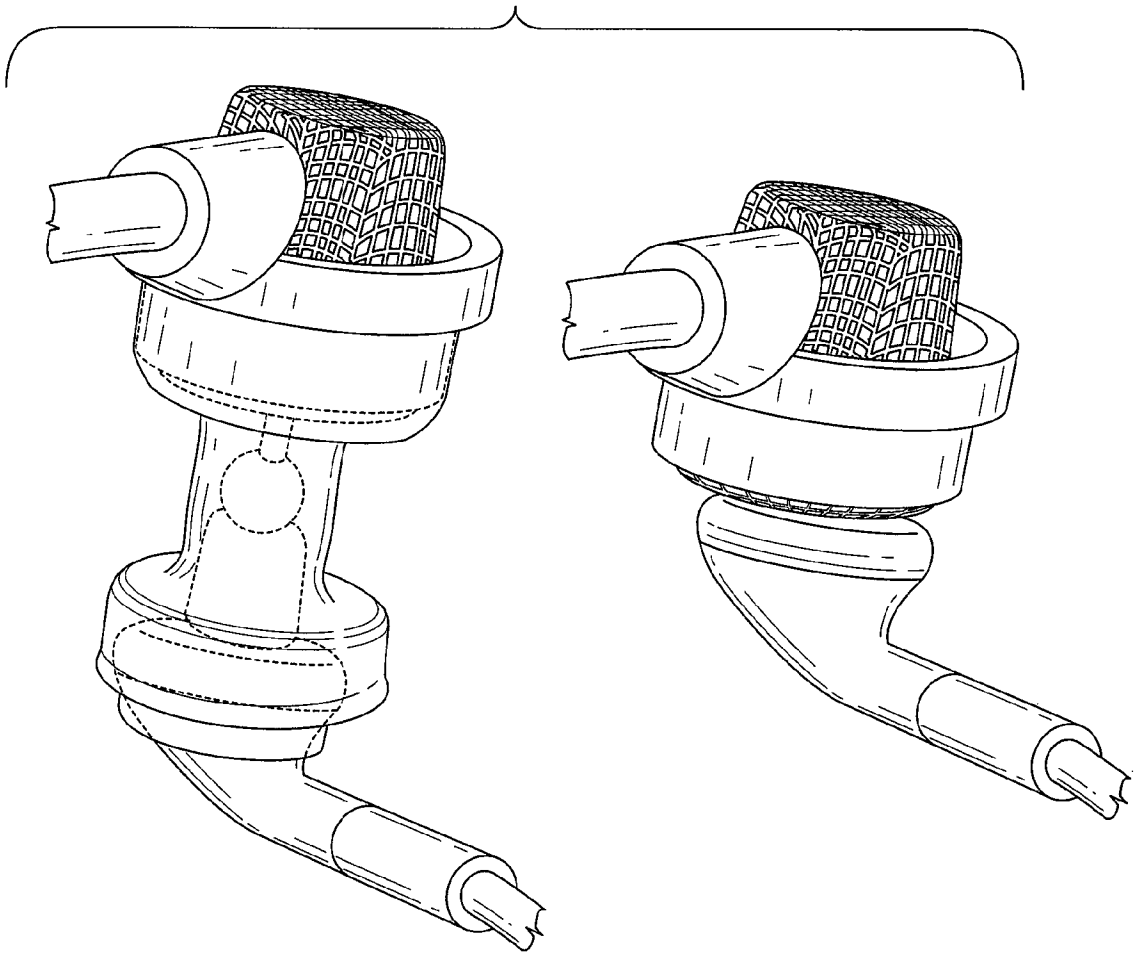
FIG. 23 shows the experimental set-up used to test embodiments of the device.

FIG. 22 shows four different test results (measurements of the 20 Hz to 20 kHz audio sine wave frequency sweep signal emissions) all with the distance between the iPod® audio transducer and the Crown® CM-311A microphone separated by 25 mm, i.e. the average ear canal length in an adult. Curve (A) shows the result when the microphone is placed in the open air (no tube) 25 mm from the front of the transducer. Curve (B) shows the result when the microphone and the transducer are sealed at opposite ends of a 25 mm tube, with no bubble portion 170 used. Curves (C) and (D) show the result when a diaphonic membrane bubble portion is employed in the 25 mm tube connecting the transducer to the microphone. The two curves represent two different bubble pressure levels and thus two different impedance matching conditions. Graph line (E) represents the 20 Hz to 20 kHz audio sine wave frequency sweep signal emissions measured at the iPod® audio transducer input.

At a distance of 25 mm in the open air Curve (A) the volume of the response is greatly reduced. Additionally, there is a sharp decrease at about 7 kHz. When the 25 mm tube is added, but with no diaphonic membrane bubble, a very bass-dominated non-flat response Curve (B) results. This is very similar to the response shown in FIG. 19 which was also for a sealed tube configuration without the diaphonic membrane bubble. This response, which approximates a conventional device sealed to the ear, is highly undesirable. Curves (C) and (D) with the diaphonic membrane bubble portion 170 employed, show an overall flatter response while maintaining good volume. Curve (C) shows a response with enhanced bass response while Curve (C) shows the capability of rolling off (reducing) the bass frequencies. In addition to other advantages of the expandable bubble portion, another significant aspect of the device is that by adjusting the membrane or bubble pressure, curves (C) and (D) as well as a continuous range of curves beyond or in between these can be realized to suit the listener's preference. This is the impedance matching utility of embodiments of the inventive device to the tympanic membrane and ear canal. By varying the adjustable threshold relief valve, as well as the membrane wall thickness and perforation parameters, impedance matching is also independently and simultaneously afforded to the audio transducer. The combination of these impedance matching factors alone, results in a greatly enhanced audio experience for the listener.

While embodiments of the invention have been shown and described, modifications thereof can be made by one skilled in the art without departing from the spirit and teachings of the invention. The embodiments described and the examples provided herein are exemplary only, and are not intended to be limiting. Many variations and modifications of the invention disclosed herein are possible and are within the scope of the invention. Accordingly, the scope of protection is not limited by the description set out above, but is only limited by the claims which follow, that scope including all equivalents of the subject matter of the claims.

The discussion of a reference is not an admission that it is prior art to the present invention, especially any reference that may have a publication date after the priority date of this application. The disclosures of all patents, patent applications, and publications cited herein are hereby incorporated herein by reference in their entirety, to the extent that they provide exemplary, procedural, or other details supplementary to those set forth herein.

What is claimed is:

1. An acoustic device comprising:

an acoustic transducer having a proximal surface and a distal surface;

an expandable bubble portion coupled to a diaphonic assembly and in fluid communication with the proximal surface of said acoustic transducer, said expandable bubble portion being configured to completely seal the proximal surface of said acoustic transducer, wherein said expandable bubble portion:

has an inflated state and a collapsed state, is filled with a fluid medium in said inflated state is adapted to conform to an ear canal in said inflated state, and expands to the inflated state via pressure generated by said acoustic transducer.

2. The acoustic device of claim 1 wherein said diaphonic assembly is disposed between said expandable bubble portion and said acoustic transducer.

3. The acoustic device of claim 2 wherein said diaphonic assembly comprises one or more substrates.

4. The acoustic device of claim 3 wherein said one or more substrates comprises one or more ingress valves and one or more egress valves.

5. The acoustic device of claim 4 wherein said ingress valves and said egress valves comprise one or more ports and at least a diaphragm membrane.

6. The acoustic device of claim 2 wherein said diaphonic assembly is disposed distal to said acoustic transducer.

7. The acoustic device of claim 2 wherein said diaphonic assembly is disposed proximal to said acoustic transducer.

8. The acoustic device of claim 1, further comprising a means for inflating said expandable bubble portion coupled to said expandable bubble portion.

9. The acoustic device of claim 8 wherein said means for inflating said expandable bubble portion comprises said acoustic transducer.

10. The acoustic device of claim 1, further comprising a pressure release valve, a pump, or combinations thereof for releasing pressure within said expandable bubble portion.

11. The acoustic device of claim 1 wherein said acoustic transducer comprises one of either a speaker, a diaphragm transducer, a driver, a personal listening device ear-bud, a hearing aid, or combinations thereof.

12. The acoustic device of claim 1 wherein said expandable bubble portion comprises a polymeric material.

13. The acoustic device of claim 12 wherein said polymeric material is an elastic polymer.

14. The acoustic device of claim 12 wherein said polymeric material is selected from the group consisting of a block copolymer, triblock copolymers, graft copolymers, silicone rubbers, natural rubbers, synthetic rubbers, plasticized polymers, vinyl polymers, or combinations thereof.

15. The acoustic device of claim 14 wherein said block copolymers have a molecular structure selected from the group consisting of AB, ABA, ABAB, ABABA, wherein A is a glassy or semicrystalline polymer, and B is a elastomer or rubber.

16. The acoustic device of claim 12 wherein said polymeric material is a graft copolymer with a rubbery backbone and a plurality of glassy side branches.

17. The acoustic device of claim 1 wherein said expandable bubble portion comprises an inelastic material.

18. The acoustic device of claim 10 wherein said inelastic material is selected from the group consisting of polyolefins, polyethylene (PE), low density polyethylene (LDPE), linear low density polyethylene (LLDPE), high density polyethylene (HDPE), ultrahigh density polyethylene (UHDPE), polyproplylene (PP), ethylene-propylene copolymers, poly (ethylene vinylacetate) (EVA), poly(ethylene acrylic acid) (EAA), polyacrylates, polymethylacrylate, polyethylacrylate, polybutylacrylate, polyvinylchloride (PVC), polyvinylidenechloride (PVDC), polyvinylidenefluoride (PVDF), polytetrafluoroethylene (PTFE), expanded polytetrafluoroethylene (ePTFE), polyvinylbutyral (PVB), poly(methylmethacrylate) (PMMA), polyvinylalchohol, polyethylenevinylalchohol (EVOH), poly(ethylene teraphathalate) (PET), polyesters, polyamides, polyureathanes, segmented polyurethanes with MDI or TDI hard segments, polyethyleneoxide, methylcellulose, ethylcellulose, hydroxyethylcellulose, carboxymethylcellulose, propylcellulose, hydroxypropylcellulose, or combinations thereof.

19. The acoustic device of claim 1 wherein said expandable bubble portion is impedance matched with said acoustic transducer.

20. The acoustic device of claim 1 wherein said expandable bubble portion is impedance matched with one of either an ear canal, a tympanic membrane, or an auricle.

21. The acoustic device of claim 1 wherein said expandable bubble portion is in fluid communication with said acoustic transducer by a port or a tube.

22. The acoustic device of claim 1 wherein at least a portion of said expandable bubble portion is porous.

23. The acoustic device of claim 22 wherein said expandable bubble portion has pores having an average diameter less than about 1 micron.

24. The acoustic device of claim 1 wherein said expandable bubble portion surrounds said acoustic transducer, and the back of said acoustic transducer is in fluid communication with an equalizing pressure source.

25. The acoustic device of claim 24 wherein said equalizing pressure source is ambient atmospheric pressure.

26. The acoustic device of claim 1, further comprising one or more microphones attached to said acoustic device.

27. The acoustic device of claim 1, further including a portable media player, cell phone, personal digital assistant, or combinations thereof.

28. The acoustic device of claim 1 wherein said expandable bubble portion comprises two or more internal chambers.

29. The acoustic device of claim 1 wherein the internal pressure of said expandable bubble portion is adjustable.

30. The acoustic device of claim 1 wherein the porous expandable bubble portion is pleated or folded in said collapsed state.

31. The acoustic device of claim 1 wherein said porous expandable bubble portion is substantially spherical in said inflated state.

32. The acoustic device of claim 1 wherein said expandable bubble portion in said inflated state comprises a toroidal shape.

33. The acoustic device of claim 1 wherein said expandable bubble portion is acoustically resonant.

34. The acoustic device of claim 1 wherein said fluid medium is a gas, a liquid, or combinations thereof.

35. An acoustic device comprising:

an expandable bubble portion;

an acoustic transducer disposed distal to said expandable bubble portion;

a diaphonic assembly coupled to said expandable bubble portion and said acoustic transducer, said diaphonic assembly comprising a distal substrate, a medial substrate, a proximal substrate, a one-way egress valve and a one-way ingress valve, wherein said distal substrate comprises an ingress port and an egress valve seat, said medial substrate comprises an egress diaphragm and an ingress diaphragm, said proximal substrate comprises an egress port and an ingress valve seat, and said egress valve opens when said transducer is displaced proximally and wherein said ingress valve closes when said transducer is displaced distally.

36. The acoustic device of claim 35 wherein said egress valve and said ingress valve comprise a valve seat, one or more ports, and one or more diaphragm membranes.

37. The acoustic device of claim 35 wherein said diaphonic assembly simultaneously transmits audio frequency vibrations while pressurizing said expandable bubble portion.

38. The acoustic device of claim 35 wherein said expandable bubble portion comprises a spheroid or prolate spheroid shape.

39. The acoustic device of claim 35, further comprising a pump coupled to said acoustic device for expanding said expandable bubble portion.

40. A method of preventing cerumen buildup in an ear canal comprising the steps of:

providing an acoustic device comprising:

an acoustic transducer having a proximal surface and a distal surface;

an expandable bubble portion coupled to a diaphonic assembly and in fluid communication with the proximal surface of said acoustic transducer, said expandable bubble portion being configured to completely seal the proximal surface of said acoustic transducer, wherein said expandable bubble portion:

has an inflated state and a collapsed state, is filled with a fluid medium in said inflated state, is adapted to conform to an ear canal in said inflated state, and expands to the inflated state via pressure generated by said acoustic transducer;

inserting the expandable bubble portion of the acoustic device into an ear canal;

expanding the expandable bubble portion with a fluid medium to seal the ear canal; and allowing vapors from the ear canal to pass through the expandable bubble portion so as to dry the ear canal and prevent cerumen buildup in the ear canal.

41. A method of noise cancellation comprising the steps of:

providing an acoustic device comprising:

an acoustic transducer having a proximal surface and a distal surface;

an expandable bubble portion coupled to a diaphonic assembly and in fluid communication with the proximal surface of said acoustic transducer, said expandable bubble portion being configured to completely seal the proximal surface of said acoustic transducer, wherein said expandable bubble portion:

has an inflated state and a collapsed state, is filled with a fluid medium in said inflated state, is adapted to conform to an ear canal in said inflated state, and expands to the inflated state via pressure generated by said acoustic transducer;

inserting the expandable bubble portion of the acoustic device into an ear canal; and transmitting vibrations, which are out of phase from ambient noise, from the acoustic transducer to the expandable bubble portion so as to cancel external noise, wherein the expandable bubble portion conducts the vibrations through the ear canal.

42. A method for conducting sound through cephalic tissue comprising the steps of:

providing a headphone having an acoustic device comprising:

an acoustic transducer having a proximal surface and a distal surface;

an expandable bubble portion coupled to a diaphonic assembly and in fluid communication with the proximal surface of said acoustic transducer, said expandable bubble portion being configured to completely seal the proximal surface of said acoustic transducer, wherein said expandable bubble portion:

has an inflated state and a collapsed state, is filled with a fluid medium in said inflated state, is adapted to conform to an ear canal in said inflated state, and expands to the inflated state via pressure generated by said acoustic transducer;

inserting the expandable bubble portion of the acoustic device into an ear canal;

expanding the expandable bubble portion with a fluid medium to contact the expandable bubble portion with the ear canal; and resonating the expandable bubble portion in contact with the ear canal via the acoustic transducer so as to conduct sound through cephalic tissue.

43. A method of transmitting sound to an ear comprising the steps of:

providing an acoustic device comprising:

an acoustic transducer having a proximal surface and a distal surface, and an expandable bubble portion in fluid communication with the proximal surface of the acoustic transducer, wherein said expandable bubble portion has an inflated state and a collapsed state, wherein the expandable bubble portion is filled with a fluid medium and forms a seal within the ear in the inflated state;

inserting the expandable bubble portion into an ear canal; and transmitting sound through the acoustic transducer into the expandable bubble portion so as to inflate the expandable bubble portion to the inflated state, resonate the expandable bubble portion and transmit sound to the ear.

44. The method of claim 43, further comprising conducting sound from the expandable bubble portion through an ear canal wall.

45. The method of claim 43 wherein the expandable bubble portion is porous.

46. The method of claim 45, further comprising continuously refreshing air within an ear canal through the expandable bubble portion.

* * * * *